US012226678B2

(12) United States Patent
Beach et al.

(10) Patent No.: US 12,226,678 B2
(45) **Date of Patent: *Feb. 18, 2025**

(54) GOLF CLUB HEAD

(71) Applicant: Taylor Made Golf Company, Inc., Carlsbad, CA (US)

(72) Inventors: Todd P. Beach, Encinitas, CA (US); Peter L. Larsen, San Marcos, CA (US); Joseph Henry Hoffman, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/202,025

(22) Filed: May 25, 2023

(65) Prior Publication Data

US 2023/0381602 A1 Nov. 30, 2023

Related U.S. Application Data

(63) Continuation of application No. 17/586,960, filed on Jan. 28, 2022, now Pat. No. 11,724,163, which is a (Continued)

(51) Int. Cl.

| | |
|---|---|
| ***A63B 53/06*** | (2015.01) |
| ***A63B 53/04*** | (2015.01) |
| ***A63B 60/02*** | (2015.01) |

(52) U.S. Cl.

CPC ..... *A63B 53/0466* (2013.01); *A63B 60/02* (2015.10); *A63B 53/0408* (2020.08); (Continued)

(58) Field of Classification Search

CPC ..... A63B 53/0408; A63B 53/0466; A63B 2053/0491

See application file for complete search history.

(56) References Cited

U.S. PATENT DOCUMENTS

| | | | |
|---|---|---|---|
| 1,518,316 | A | 12/1924 | Ellingham |
| 1,526,438 | A | 2/1925 | Scott |

(Continued)

FOREIGN PATENT DOCUMENTS

| | | |
|---|---|---|
| DE | 9012884 | 9/1990 |
| EP | 1001175 A2 | 5/2000 |

(Continued)

OTHER PUBLICATIONS

Callaway Golf, World's Straightest Driver: FT-i Driver downloaded from www.callawaygolf.com/ft%2Di/driver.aspx?lang=en on Apr. 5, 2007.

(Continued)

*Primary Examiner* — Alvin A Hunter

(74) *Attorney, Agent, or Firm* — Klarquist Sparkman, LLP

(57) ABSTRACT

Disclosed herein are various embodiments of a golf club head having improved mass distribution characteristics. The golf club head includes a body and a face positioned at a forward portion of the body. The golf club head also includes one or more mass elements positioned at predetermined locations about the head. The mass elements assist in achieving a desired relationship between the moment of inertia about a center of gravity x-axis and the moment of inertia about a center of gravity z-axis.

61 Claims, 14 Drawing Sheets

Related U.S. Application Data continuation of application No. 17/107,474, filed on Nov. 30, 2020, now Pat. No. 11,278,773, which is a continuation of application No. 16/752,397, filed on Jan. 24, 2020, now Pat. No. 10,874,918, which is a continuation of application No. 16/241,826, filed on Jan. 7, 2019, now Pat. No. 10,576,338, which is a continuation of application No. 15/827,848, filed on Nov. 30, 2017, now Pat. No. 10,220,270, which is a continuation of application No. 15/240,769, filed on Aug. 18, 2016, now Pat. No. 9,849,353, which is a continuation of application No. 14/177,094, filed on Feb. 10, 2014, now Pat. No. 9,452,324, which is a continuation of application No. 12/775,359, filed on May 6, 2010, now Pat. No. 8,647,216, which is a continuation of application No. 11/863,198, filed on Sep. 27, 2007, now Pat. No. 7,731,603.

(52) U.S. Cl.
CPC ..... *A63B 53/0412* (2020.08); *A63B 53/0433* (2020.08); *A63B 53/045* (2020.08); *A63B 53/0454* (2020.08); *A63B 53/0458* (2020.08); *A63B 2225/01* (2013.01)

(56) References Cited

U.S. PATENT DOCUMENTS 1,538,312 A 5/1925 Beat
1,592,463 A 7/1926 Marker
1,658,581 A 2/1928 Tobia
1,704,119 A 3/1929 Buhrke
2,214,356 A 9/1940 Wettlaufer
2,225,930 A 12/1940 Sexton
2,360,364 A 10/1944 Reach
2,460,435 A 2/1949 Schaffer
3,064,980 A 11/1962 Steiner
3,466,047 A 9/1969 Rodia et al.
3,486,755 A 12/1969 Hodge
3,556,533 A 1/1971 Hollis
3,589,731 A 6/1971 Chancellor
3,606,327 A 9/1971 Gorman
3,610,630 A 10/1971 Glover
3,652,094 A 3/1972 Glover
3,692,306 A 9/1972 Glover
3,743,297 A 7/1973 Dennis
3,897,066 A 7/1975 Belmont
3,976,299 A 8/1976 Lawrence et al.
3,979,122 A 9/1976 Belmont
3,979,123 A 9/1976 Belmont
3,984,103 A 10/1976 Nix
4,008,896 A 2/1977 Gordos
4,043,563 A 8/1977 Churchward
4,052,075 A 10/1977 Daly
4,076,254 A 2/1978 Nygren
4,085,934 A 4/1978 Churchward
4,121,832 A 10/1978 Ebbing
4,165,874 A 8/1979 Lezatte et al.
4,214,754 A 7/1980 Zebelean
4,340,229 A 7/1982 Stuff, Jr.
4,411,430 A 10/1983 Dian
4,423,874 A 1/1984 Stuff, Jr.
4,432,549 A 2/1984 Zebelean
4,438,931 A 3/1984 Motomiya
4,530,505 A 7/1985 Stuff
4,602,787 A 7/1986 Sugioka et al.
4,607,846 A 8/1986 Perkins
4,679,791 A 7/1987 Hull
4,712,798 A 12/1987 Preato
4,730,830 A 3/1988 Tilley
4,754,977 A 7/1988 Sahm
4,795,159 A 1/1989 Nagamoto
4,819,939 A 4/1989 Kobayashi
4,867,457 A 9/1989 Lowe
4,867,458 A 9/1989 Sumikawa et al.
4,869,507 A 9/1989 Sahm
4,895,371 A 1/1990 Bushner
4,957,294 A 9/1990 Long
4,962,932 A 10/1990 Anderson
5,050,879 A 9/1991 Sun et al.
5,058,895 A 10/1991 Igarashi
5,244,210 A 9/1993 Au
5,253,869 A 10/1993 Dingle et al.
5,316,305 A 5/1994 McCabe
5,328,176 A 7/1994 Lo
5,385,348 A 1/1995 Wargo
5,410,798 A 5/1995 Lo
5,421,577 A 6/1995 Kobayashi
5,429,365 A 7/1995 McKeighen
5,439,222 A 8/1995 Kranenberg
5,441,274 A 8/1995 Clay
5,447,309 A * 9/1995 Vincent ..... A63B 53/04 473/335
5,482,280 A 1/1996 Yamawaki
5,509,659 A * 4/1996 Igarashi ..... A63B 53/0466 473/345
5,518,243 A 5/1996 Redman
5,533,730 A 7/1996 Ruvang
5,571,053 A 11/1996 Lane
5,620,379 A 4/1997 Borys
5,624,331 A 4/1997 Lo et al.
5,629,475 A 5/1997 Chastonay
5,632,694 A 5/1997 Lee
5,669,827 A * 9/1997 Nagamoto ..... A63B 60/00 473/345
5,683,309 A 11/1997 Reimers
5,709,613 A 1/1998 Sheraw
5,718,641 A 2/1998 Lin
5,720,674 A * 2/1998 Galy ..... A63B 53/0466 473/335
5,746,664 A 5/1998 Reynolds, Jr.
5,755,627 A 5/1998 Yamazaki et al.
5,769,737 A 6/1998 Holladay et al.
5,776,011 A 7/1998 Su et al.
RE35,955 E 11/1998 Lu
5,873,791 A 2/1999 Allen
5,908,356 A 6/1999 Nagamoto
5,911,638 A 6/1999 Parente et al.
5,935,019 A 8/1999 Yamamoto
5,941,782 A 8/1999 Cook
5,947,840 A 9/1999 Ryan
5,954,596 A 9/1999 Noble et al.
5,967,905 A 10/1999 Nakahara et al.
5,997,415 A 12/1999 Wood
6,015,354 A 1/2000 Ahn et al.
6,056,649 A 5/2000 Imai
6,080,068 A * 6/2000 Takeda ..... A63B 53/04 473/307
6,089,994 A 7/2000 Sun
6,149,533 A 11/2000 Finn
6,162,133 A 12/2000 Peterson
6,238,303 B1 5/2001 Fite
6,244,974 B1 6/2001 Hanberry, Jr.
6,254,494 B1 * 7/2001 Hasebe ..... A63B 53/04 473/345
6,270,422 B1 8/2001 Fisher
6,277,032 B1 8/2001 Smith
6,299,547 B1 10/2001 Kosmatka
6,332,848 B1 * 12/2001 Long ..... A63B 53/0466 473/328
6,334,817 B1 1/2002 Ezawa et al.
6,338,683 B1 1/2002 Kosmatka
6,348,014 B1 2/2002 Chiu
6,354,962 B1 * 3/2002 Galloway ..... A63B 53/04 473/345
6,379,265 B1 4/2002 Hirakawa et al.
6,383,090 B1 5/2002 O'Doherty et al.
6,390,933 B1 * 5/2002 Galloway ..... A63B 53/0466 473/305
6,398,666 B1 6/2002 Evans et al.
6,409,612 B1 6/2002 Evans et al.

(56) References Cited

U.S. PATENT DOCUMENTS 6,425,832 B2 7/2002 Cackett et al.
6,428,425 B1 8/2002 Naruo et al.
6,435,982 B1 * 8/2002 Galloway ..... C23F 1/00 473/345
6,440,009 B1 8/2002 Guibaud et al.
6,471,604 B2 10/2002 Hocknell et al.
6,491,592 B2 12/2002 Cackett et al.
6,514,154 B1 2/2003 Finn
6,524,197 B2 2/2003 Boone
6,527,649 B1 3/2003 Neher et al.
6,530,848 B2 3/2003 Gillig
6,547,676 B2 4/2003 Cackett et al.
6,565,448 B2 5/2003 Cameron et al.
6,565,452 B2 5/2003 Helmstetter et al.
6,572,489 B2 * 6/2003 Miyamoto ..... A63B 53/0466 473/290
6,575,845 B2 * 6/2003 Galloway ..... C23F 1/00 473/345
6,582,321 B2 * 6/2003 Galloway ..... B21J 5/00 473/345
6,582,323 B2 6/2003 Soracco et al.
6,602,149 B1 * 8/2003 Jacobson ..... A63B 60/00 473/345
6,605,007 B1 8/2003 Bissonnette et al.
6,607,452 B2 8/2003 Helmstetter et al.
6,612,938 B2 9/2003 Murphy et al.
6,620,056 B2 * 9/2003 Galloway ..... A63B 53/02 473/345
6,641,487 B1 11/2003 Hamburger
6,648,773 B1 * 11/2003 Evans ..... A63B 53/0466 473/345
6,669,571 B1 12/2003 Cameron et al.
6,669,578 B1 * 12/2003 Evans ..... A63B 53/0466 473/345
6,669,580 B1 12/2003 Cackett et al.
6,676,536 B1 1/2004 Jacobson
6,719,645 B2 * 4/2004 Kouno ..... A63B 60/00 473/345
6,739,982 B2 5/2004 Murphy et al.
6,739,983 B2 * 5/2004 Helmstetter ..... A63B 53/0466 473/335
6,743,118 B1 6/2004 Soracco
6,758,763 B2 7/2004 Murphy et al.
6,773,360 B2 8/2004 Willett et al.
6,800,038 B2 10/2004 Willett et al.
6,824,475 B2 11/2004 Burnett et al.
6,832,961 B2 * 12/2004 Sano ..... A63B 53/0466 473/324
6,860,818 B2 3/2005 Mahaffey et al.
6,860,823 B2 3/2005 Lee
6,860,824 B2 3/2005 Evans
6,875,129 B2 4/2005 Erickson et al.
6,878,073 B2 4/2005 Takeda
6,881,159 B2 4/2005 Galloway et al.
6,904,663 B2 6/2005 Willett et al.
6,926,619 B2 8/2005 Helmstetter et al.
6,960,142 B2 11/2005 Bissonnette et al.
6,964,617 B2 * 11/2005 Williams ..... A63B 53/0466 473/345
6,974,393 B2 12/2005 Caldwell et al.
6,979,270 B1 12/2005 Allen
6,988,960 B2 1/2006 Mahaffey et al.
6,991,558 B2 * 1/2006 Beach ..... A63B 60/00 473/324
6,997,820 B2 2/2006 Willett et al.
6,997,821 B2 * 2/2006 Galloway ..... A63B 60/02 473/345
7,004,852 B2 2/2006 Billings
7,025,692 B2 4/2006 Erickson et al.
7,029,403 B2 4/2006 Rice et al.
7,056,228 B2 6/2006 Beach et al.
7,059,973 B2 * 6/2006 Erickson ..... A63B 53/0466 473/332
7,070,517 B2 * 7/2006 Cackett ..... A63B 53/0466 473/348
7,140,974 B2 11/2006 Chao et al.
7,153,220 B2 12/2006 Lo
7,163,468 B2 * 1/2007 Gibbs ..... A63B 53/02 473/335
7,166,040 B2 1/2007 Hoffman et al.
7,169,060 B2 1/2007 Stevens et al.
7,186,190 B1 * 3/2007 Beach ..... A63B 53/06 473/335
7,189,169 B2 3/2007 Billings
7,198,575 B2 4/2007 Beach et al.
7,223,180 B2 5/2007 Willett et al.
7,247,103 B2 7/2007 Beach et al.
7,252,600 B2 8/2007 Murphy et al.
7,255,654 B2 8/2007 Murphy et al.
7,258,626 B2 * 8/2007 Gibbs ..... A63B 53/02 473/345
7,278,927 B2 * 10/2007 Gibbs ..... A63B 53/02 473/335
7,448,963 B2 11/2008 Beach et al.
7,621,823 B2 * 11/2009 Beach ..... A63B 53/06 473/347
7,713,143 B2 5/2010 Evans
7,731,603 B2 * 6/2010 Beach ..... A63B 53/0466 473/335
7,736,245 B2 6/2010 Hasegawa
7,771,291 B1 * 8/2010 Willett ..... A63B 53/0466 473/345
7,798,914 B2 9/2010 Noble et al.
7,850,542 B2 * 12/2010 Cackett ..... A63B 53/0466 473/316
7,938,742 B2 * 5/2011 Galloway ..... A63B 53/0466 473/345
8,262,507 B1 * 9/2012 Willett ..... A63B 53/0466 473/335
8,353,786 B2 1/2013 Beach et al.
8,647,216 B2 * 2/2014 Beach ..... A63B 60/00 473/335
8,801,541 B2 8/2014 Beach et al.
9,452,324 B2 * 9/2016 Beach ..... A63B 60/02
9,675,849 B2 6/2017 Beach et al.
9,849,353 B2 * 12/2017 Beach ..... A63B 60/02
10,220,270 B2 * 3/2019 Beach ..... A63B 53/0466
10,576,338 B2 * 3/2020 Beach ..... A63B 60/00
10,874,918 B2 * 12/2020 Beach ..... A63B 60/00
11,278,773 B2 * 3/2022 Beach ..... A63B 53/0466
11,724,163 B2 * 8/2023 Beach ..... A63B 53/0466 473/335
2001/0049310 A1 12/2001 Cheng et al.
2001/0055995 A1 * 12/2001 Cackett ..... C22F 1/183 473/342
2002/0006836 A1 * 1/2002 Helmstetter ..... B29C 70/342 473/345
2002/0019267 A1 * 2/2002 Cackett ..... B29C 70/342 473/345
2002/0022535 A1 2/2002 Takeda
2002/0055393 A1 * 5/2002 Reyes ..... A63B 53/02 473/305
2002/0072434 A1 6/2002 Yabu
2002/0137576 A1 9/2002 Dammen
2002/0160854 A1 10/2002 Beach et al.
2003/0040376 A1 * 2/2003 Cackett ..... A63B 60/00 473/345
2003/0130059 A1 7/2003 Billings
2004/0087388 A1 5/2004 Beach et al.
2004/0242343 A1 12/2004 Chao
2004/0248667 A1 * 12/2004 Cackett ..... A63B 53/0466 473/349
2005/0101404 A1 5/2005 Long et al.
2005/0239575 A1 10/2005 Chao et al.
2006/0058112 A1 3/2006 Haralason et al.
2006/0154747 A1 7/2006 Beach
2007/0105647 A1 5/2007 Beach et al.
2007/0105648 A1 5/2007 Beach et al.
2007/0105649 A1 5/2007 Beach et al.
2007/0105650 A1 5/2007 Beach et al.

(56) References Cited

U.S. PATENT DOCUMENTS

| | | | | |
|---|---|---|---|---|
| 2007/0105651 | A1 | 5/2007 | Beach et al. | |
| 2007/0105652 | A1 | 5/2007 | Beach et al. | |
| 2007/0105653 | A1 | 5/2007 | Beach et al. | |
| 2007/0105654 | A1 | 5/2007 | Beach et al. | |
| 2007/0105655 | A1 | 5/2007 | Beach et al. | |
| 2007/0129167 | A1 | 6/2007 | Matsunaga | |
| 2008/0161127 | A1 * | 7/2008 | Yamamoto | A63B 60/00 473/345 |
| 2008/0261717 | A1 | 10/2008 | Hoffman et al. | |
| 2008/0280698 | A1 | 11/2008 | Hoffman et al. | |
| 2009/0017938 | A1 | 1/2009 | Yokota | |
| 2009/0088271 | A1 | 4/2009 | Beach et al. | |
| 2010/0216570 | A1 | 8/2010 | Beach et al. | |
| 2010/0273572 | A1 | 10/2010 | Beach et al. | |
| 2014/0155194 | A1 | 6/2014 | Beach et al. | |
| 2015/0018115 | A1 | 1/2015 | Beach et al. | |
| 2022/0241654 | A1 | 8/2022 | Beach et al. | |

FOREIGN PATENT DOCUMENTS

| | | | | |
|---|---|---|---|---|
| EP | 1125601 | A1 * | 8/2001 | |
| EP | 0982052 | A1 | 3/2002 | |
| GB | 194823 | | 12/1921 | |
| JP | 06-304271 | | 4/1993 | |
| JP | 05-317465 | | 12/1993 | |
| JP | 06-126004 | | 5/1994 | |
| JP | 06-343721 | | 12/1994 | |
| JP | 06343721 | A * | 12/1994 | |
| JP | 07-275411 | | 10/1995 | |
| JP | 08-243194 | | 9/1996 | |
| JP | 09-028844 | | 2/1997 | |
| JP | 09173510 | | 7/1997 | |
| JP | 09-308717 | | 12/1997 | |
| JP | 09-327534 | | 12/1997 | |
| JP | 10-216272 | | 8/1998 | |
| JP | 10-234902 | | 8/1998 | |
| JP | 10216272 | A * | 8/1998 | |
| JP | 10-234891 | | 9/1998 | |
| JP | 10234891 | A * | 9/1998 | |
| JP | 10-277182 | | 10/1998 | |
| JP | 10-277187 | | 10/1998 | |
| JP | 11-104277 | | 4/1999 | |
| JP | 11104277 | A * | 4/1999 | |
| JP | 11299937 | | 11/1999 | |
| JP | 2000176056 | | 6/2000 | |
| JP | 200300701 | | 10/2000 | |
| JP | 2000300701 | A * | 10/2000 | |
| JP | 2001120692 | | 5/2001 | |
| JP | 2001120692 | A * | 5/2001 | A63B 53/0408 |
| JP | 2001170229 | | 6/2001 | |
| JP | 2001238988 | | 9/2001 | |
| JP | 2001-321466 | | 11/2001 | |
| JP | 2001321466 | A * | 11/2001 | |
| JP | 2002143350 | | 5/2002 | |
| JP | 2002315854 | | 10/2002 | |
| JP | 2003102877 | | 4/2003 | |
| JP | 2003245381 | | 9/2003 | |
| JP | 2003245381 | A * | 9/2003 | A63B 53/02 |
| JP | 2003290396 | | 10/2003 | |
| JP | 2004135730 | | 5/2004 | |
| JP | 2004222911 | | 8/2004 | |
| JP | 2004261451 | | 9/2004 | |
| JP | 2004267438 | | 9/2004 | |
| JP | 2004358225 | | 12/2004 | |
| JP | 2005160947 | | 6/2005 | |
| JP | 2005305169 | | 11/2005 | |
| JP | 2006149449 | | 6/2006 | |
| JP | 2006204604 | | 8/2006 | |
| JP | 2007500066 | | 1/2007 | |
| JP | 2007029588 | | 2/2007 | |
| JP | 2007151758 | | 6/2007 | |
| JP | 2008-005912 | | 1/2008 | |
| JP | 2008005912 | A * | 1/2008 | A63B 53/0466 |
| JP | 2008220665 | | 9/2008 | |
| JP | 2009018049 | | 1/2009 | |
| JP | 2009-061264 | | 3/2009 | |
| JP | 2009061264 | A * | 3/2009 | A63B 53/0466 |
| KR | 101149250 | | 5/2012 | |
| KR | 101149250 | B1 * | 5/2012 | |
| WO | WO88/02642 | | 4/1988 | |
| WO | WO01/66199 | | 9/2001 | |
| WO | WO02/062501 | | 8/2002 | |
| WO | WO03/061773 | | 7/2003 | |
| WO | WO-2005077472 | A1 * | 8/2005 | A63B 53/0466 |

OTHER PUBLICATIONS

Jackson, Jeff, The Modern Guide to Golf Clubmaking, Ohio: Dynacraft Golf Products, Inc., copyright 1994, p. 237.

Nike Golf, Sasquatch 460, downloaded from www.nike.com/nikegolf/index.htm on Apr. 5, 2007.

Nike Golf, Sasquatch Sumo Squared Driver, downloaded from www.nike.com/nikegolf/index.htm on Apr. 5, 2007.

Office action from the Japanese Patent Office in Patent Application No. 2008-247526, dated Nov. 20, 2012.

Office action from the Japanese Patent Office in Patent Application No. 2008-264852, dated Dec. 3, 2012.

Office action from the Japanese Patent Office in Patent Application No. 2008-264852, dated Mar. 4, 2014.

Taylor Made Golf Company Inc., R7 460 Drivers, downloaded from www.taylormadegolf.com/product_detail.asp?pID=14section=overview on Apr. 5, 2007.

Titleist 907D1, downloaded from www.tees2greens.com/forum/Uploads/Images/7ade3521-192b-4611-870b-395d.jpg on Feb. 1, 2007.

* cited by examiner

| | Golf Club Head | | | |
|---|---|---|---|---|
| | 2 | 100 | 200 | 300 |
| Mass (g) | 200.0 | 202.8 | 204.4 | 202.3 |
| Volume (cc) | 458 | 454 | 454 | 453 |
| CGx (mm) | 1.8 | 2.0 | 2.3 | 3.3 |
| CGy (mm) | 37.1 | 37.9 | 36.7 | 37.4 |
| CGz (mm) | -3.26 | -4.67 | -4.65 | -0.09 |
| Ixx (kg·mm²) | 339 | 337 | 333 | 336 |
| Izz (kg·mm²) | 528 | 498 | 495 | 536 |
| Loft (deg) | 9.5 | 9.5 | 10.1 | 9.5 |
| Lie (deg) | 58 | 58 | 58 | 58 |
| Bulge Radius (mm) | 304.8 | 304.8 | 304.8 | 304.8 |
| Roll Radius (mm) | 304.8 | 304.8 | 304.8 | 304.8 |
| Face Height (mm) | 58.6 | 59.6 | 56.8 | 57.2 |
| Face Width (mm) | 90.6 | 90.6 | 92.3 | 90.6 |
| Face Area (mm²) | 3929 | 4098 | 4100 | 3929 |
| Head Height (mm) | 60.7 | 62.2 | 61.5 | 59.0 |
| Head Width (mm) | 120.5 | 119.3 | 122.8 | 117.2 |
| Head Depth (mm) | 115.0 | 110.7 | 113.5 | 117.2 |

FIG. 30

| | | 400A | 400B | 400C | 400D | 400E | 400F | 400G |
|---|---|---|---|---|---|---|---|---|
| Volume (cc) | | 460 | 460 | 460 | 460 | 460 | 460 | 460 |
| Ixx (kg·mm²) | | 427 | 427 | 427 | 427 | 525 | 525 | 525 |
| Izz (kg·mm²) | | 645 | 593 | 447 | 511 | 702 | 600 | 549 |
| Ixx / Izz | | 0.66 | 0.72 | 0.96 | 0.84 | 0.75 | 0.88 | 0.96 |
| Total Head Mass (g) | | 203 | 203 | 203 | 203 | 203 | 203 | 203 |
| CM1 | Mass (g) | 36.5 | 36.5 | 36.5 | 36.5 | 27.7 | 27.7 | 27.7 |
| | X (mm) | 52.5 | 50 | 10 | 35 | 52.5 | 35 | 0 |
| | Y (mm) | 10 | 10 | 10 | 10 | 10 | 10 | 10 |
| | Z (mm) | 25.5 | 25.5 | 25.5 | 25.5 | 25.5 | 25.5 | 25.5 |
| CM2 | Mass (g) | 36.5 | 36.5 | 36.5 | 36.5 | 27.7 | 27.7 | 27.7 |
| | X (mm) | -52.5 | -40 | 0 | -25 | -52.5 | -25 | 0 |
| | Y (mm) | 10 | 10 | 10 | 10 | 10 | 10 | 10 |
| | Z (mm) | 25.5 | 25.5 | 25.5 | 25.5 | 25.5 | 25.5 | 25.5 |
| CM3 | Mass (g) | 23.9 | 23.9 | 23.9 | 23.9 | 41.5 | 41.5 | 41.5 |
| | X (mm) | 0 | 0 | 0 | 0 | 0 | 0 | 0 |
| | Y (mm) | 114.3 | 114.3 | 114.3 | 114.3 | 114.3 | 114.3 | 114.3 |
| | Z (mm) | -20 | -20 | -20 | -20 | -20 | -20 | -20 |

FIG. 31

GOLF CLUB HEAD

CROSS REFERENCE TO RELATED APPLICATION

This application is a continuation of U.S. patent application Ser. No. 17/586,960, filed Jan. 28, 2022, now U.S. Pat. No. 11,724,163, which is a continuation of U.S. patent application Ser. No. 17/107,474, filed Nov. 30, 2020, now U.S. Pat. No. 11,278,773, which is a continuation of U.S. patent application Ser. No. 16/752,397, filed Jan. 24, 2020, now U.S. Pat. No. 10,874,918, which is a continuation of U.S. patent application Ser. No. 16/241,826, filed Jan. 7, 2019, now U.S. Pat. No. 10,576,338, which is a continuation of U.S. patent application Ser. No. 15/827,848, filed Nov. 30, 2017, now U.S. Pat. No. 10,220,270, which is a continuation of U.S. patent application Ser. No. 15/240,769, filed Aug. 18, 2016, now U.S. Pat. No. 9,849,353, which is a continuation of U.S. patent application Ser. No. 14/177,094, filed Feb. 10, 2014, now U.S. Pat. No. 9,452,324, which is a continuation of U.S. patent application Ser. No. 12/775,359, filed May 6, 2010, now U.S. Pat. No. 8,647,216, which is a continuation of U.S. patent application Ser. No. 11/863,198, filed Sep. 27, 2007, now U.S. Pat. No. 7,731,603, all of which are incorporated herein by reference.

FIELD

The present application relates to a golf club head, and more particularly, to a golf club head having improved mass distribution characteristics.

BACKGROUND

Golf club head manufacturers and designers are constantly looking for ways to improve golf club head performance, which includes the forgiveness and playability of the golf club head, while having an aesthetic appearance. Generally, "forgiveness" can be defined as the ability of a golf club head to compensate for mishits, i.e., hits resulting from striking the golf ball at a less than an ideal impact location on the golf club head. Similarly, "playability" can be defined generally as the ease in which a golfer having any of various skill levels can use the golf club head for producing quality golf shots.

Golf club head performance can be directly affected by the moments of inertia of the club head. A moment of inertia is the measure of a club head's resistance to twisting upon impact with a golf ball. Generally, the higher the moments of inertia of a golf club head, the less the golf club head twists at impact with a golf ball, particularly during "off-center" impacts with a golf ball. The less a golf club head twists, the greater the forgiveness of the golf club head and the greater the probability of hitting a straight golf shot. In some instances, a golf club head with high moments of inertia may also result in an increased ball speed upon impact with the golf club head, which generally translates into increased golf shot distance.

In general, the moment of inertia of a mass about a given axis is proportional to the square of the distance of the mass away from the axis. In other words, the greater is the distance of a mass away from a given axis, the greater is the moment of inertia of the mass about the given axis. To reduce ball speed-loss on off-center golf shots, golf club head designers and manufacturers have sought to increase the moment of inertia about a golf club head z-axis extending vertically through the golf club head center of gravity, i.e., Izz. By increasing the distance of the outer periphery of the golf club head from the vertical axis, e.g., the further the golf club head extends outward away from the vertical axis, the greater the moment of inertia (Izz), and the lesser the golf club head twists about the vertical axis upon impact with a golf ball and the greater the forgiveness of the golf club head.

United States Golf Association (USGA) regulations and constraints on golf club head shapes, sizes and other characteristics tend to limit the moments of inertia achievable by a golf club head. For example, the highest moment of inertia (Izz) allowable by the USGA is currently 5,900 $g \cdot cm^2$ (590 $kg \cdot mm^2$).

Because of increased demand by golfers to hit straighter and longer golf shots, golf club manufacturers recently have produced golf club heads that increasingly approach the maximum allowed moment of inertia (Izz). Although golf club heads with high moments of inertia (Izz) may provide greater left-to-right shot shape forgiveness, such benefits are contingent upon the golfer being able to adequately square up the club face prior to impacting the golf ball. For example, if the golf club head face is too open on impact with a golf ball, the ball will have a tendency to fade or slice. The harder it is to rotate the golf club head during a swing, the more difficult it is to square the golf club head prior to impact with a golf ball and the greater the tendency to hit errant golf shots. Often, the bulkiness or size of a golf club head can negatively affect the ability of a golfer to rotate the golf club head into proper impact position. In other words, because the mass of bulkier golf club heads is distributed further away from the hosel and shaft, the moment of inertia about the shaft is increased making it harder it is to rotate the golf club head about the shaft during a swing.

Conventional golf club heads approaching the maximum allowable moment of inertia (Izz), tend to be bulkier than club heads with lower moments of inertia due to the outward extend of the periphery of the golf club head. Although the bulkiness of the golf club heads may provide a higher moment of inertia (Izz) for greater forgiveness, such benefits tend to diminish as the bulkiness of the golf club head makes it harder for a golfer to square up the golf club head. In other words, the high forgiveness of the golf club head can be negated by the inability of the golfer to square the club face due to the bulkiness of the golf club head.

SUMMARY

Described herein are embodiments of a golf club head with less bulk than some conventional high moment of inertia golf club heads but providing increased forgiveness due to a cooperative combination of moments of inertia about respective axes of the golf club head.

According to one embodiment, a golf club head comprises a body and a face. The body can define an interior cavity and comprise a sole positioned at a bottom portion of the golf club head, a crown positioned at a top portion, and a skirt positioned around a periphery between the sole and crown. The body can have a forward portion and a rearward portion. The face can be positioned at the forward portion of the body and have an ideal impact location that defines a golf club head origin. The head origin can include an x-axis tangential to the face and generally parallel to the ground when the head is ideally positioned, a y-axis generally perpendicular to the x-axis and generally parallel to the ground when the head is ideally positioned, and a z-axis perpendicular to both the x-axis and y-axis. The golf club head can have a moment of inertia about a golf club head center of gravity z-axis generally parallel to the head origin z-axis greater than approximately 500 kg·mm$^2$. Further, the ratio of a moment of inertia about a golf club head center of gravity x-axis generally parallel to the origin x-axis to the moment of inertia about the golf club head center of gravity z-axis (Ixx/Izz) is greater than approximately 0.6.

In some implementations, the ratio Ixx/Izz is greater than approximately 0.7. In other implementations, the ratio Ixx/Izz is greater than approximately 0.8. The moment of inertia about the golf club head center of gravity x-axis can be between approximately 330 kg·mm$^2$ and approximately 550 kg·mm$^2$.

The foregoing and other features and advantages of the disclosed golf club head will become more apparent from the following detailed description, which proceeds with reference to the accompanying figures.

BRIEF DESCRIPTION OF THE DRAWINGS

FIG. 30 is a chart showing various golf club head characteristics of the first, second, third and fourth golf club head embodiments.

FIG. 31 is a chart showing various golf club head characteristics of several configurations of the fifth golf club head embodiment.

DETAILED DESCRIPTION

Figure 1:
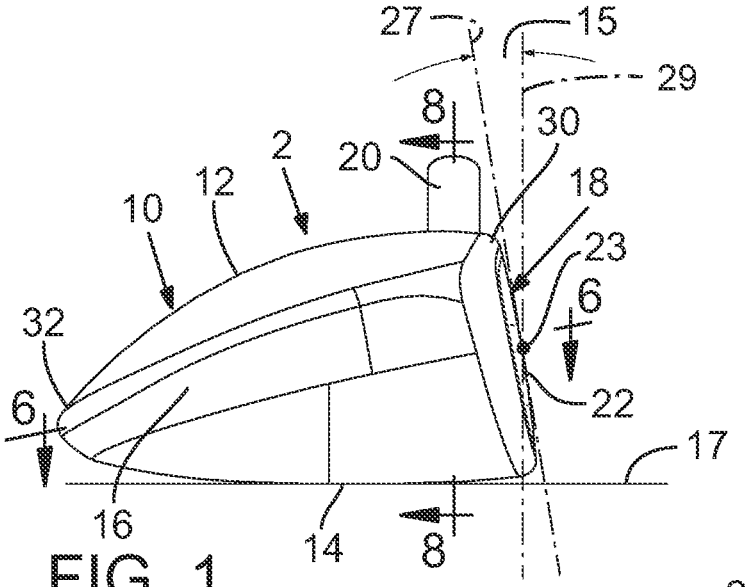
FIG. 1 is a side elevation view of a golf club head according to a first embodiment.
Figure 2:
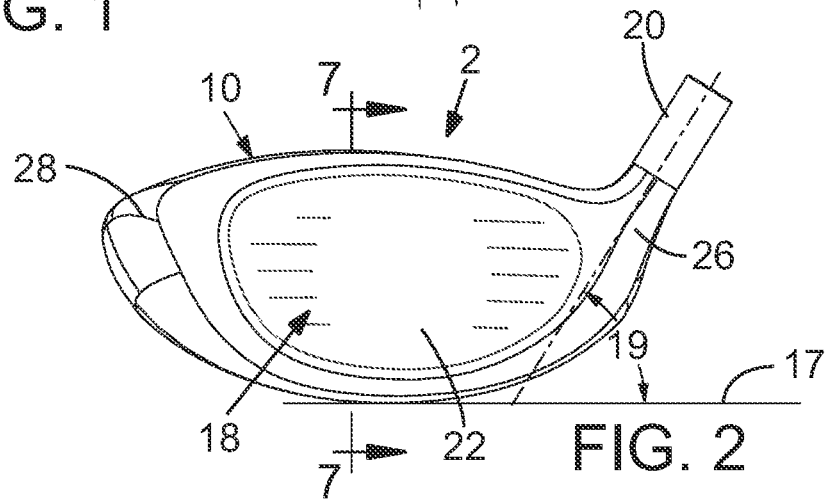
FIG. 2 is a front elevation view of the golf club head of FIG. 1.
Figure 3:
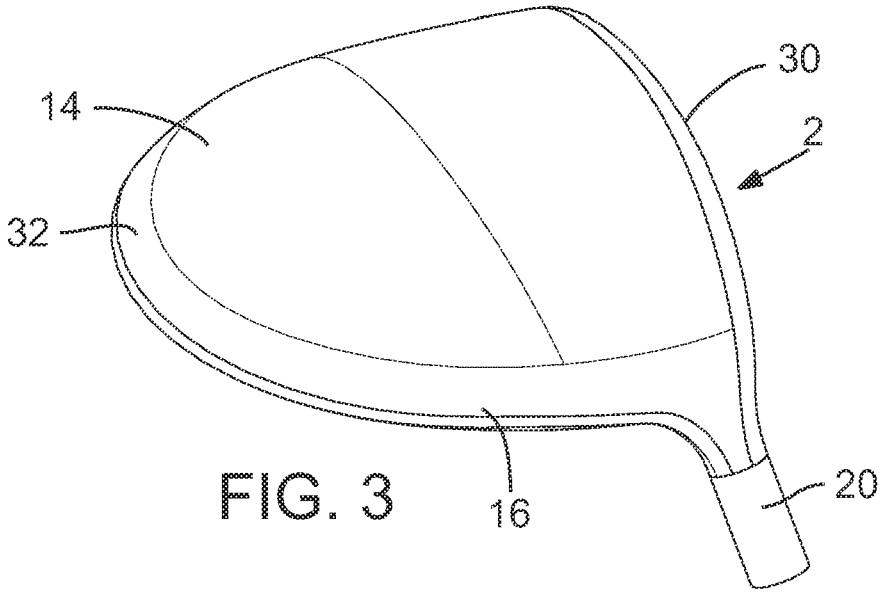
FIG. 3 is a bottom perspective view of the golf club head of FIG. 1.

In the following description, certain terms may be used such as "up," "down,", "upper," "lower," "horizontal," "vertical," "left," "right," and the like. These terms are used, where applicable, to provide some clarity of description when dealing with relative relationships, particularly with respect to the illustrated embodiments. These terms are not, however, intended to imply absolute relationships, positions, and/or orientations. For example, with respect to an object, an "upper" surface can become a "lower" surface simply by turning the object over. Nevertheless, it is still the same object.

As illustrated in FIGS. 1-9, a wood-type (e.g., driver or fairway wood) golf club head, such as golf club head 2, includes a hollow body 10. The body 10 includes a crown 12, a sole 14, a skirt 16, a striking face, or face portion, 18 defining an interior cavity 79 (see FIGS. 7-9). The body 10 can include a hosel 20, which defines a hosel bore 24 adapted to receive a golf club shaft (see FIG. 6). The body 10 further includes a heel portion 26, a toe portion 28, a front portion 30, and a rear portion 32. The club head 2 also has a volume, typically measured in cubic-centimeters (cm$^3$), equal to the volumetric displacement of the club head 2. In some implementations, the golf club head 2 has a volume between approximately 420 cm$^3$ and approximately 480 cm$^3$, and a total mass between approximately 190 g and approximately 210 g. Referring to FIG. 30, in one specific implementation, the golf club head 2 has a volume of approximately 458 cm$^3$ and a total mass of approximately 200 g.

Figure 6:
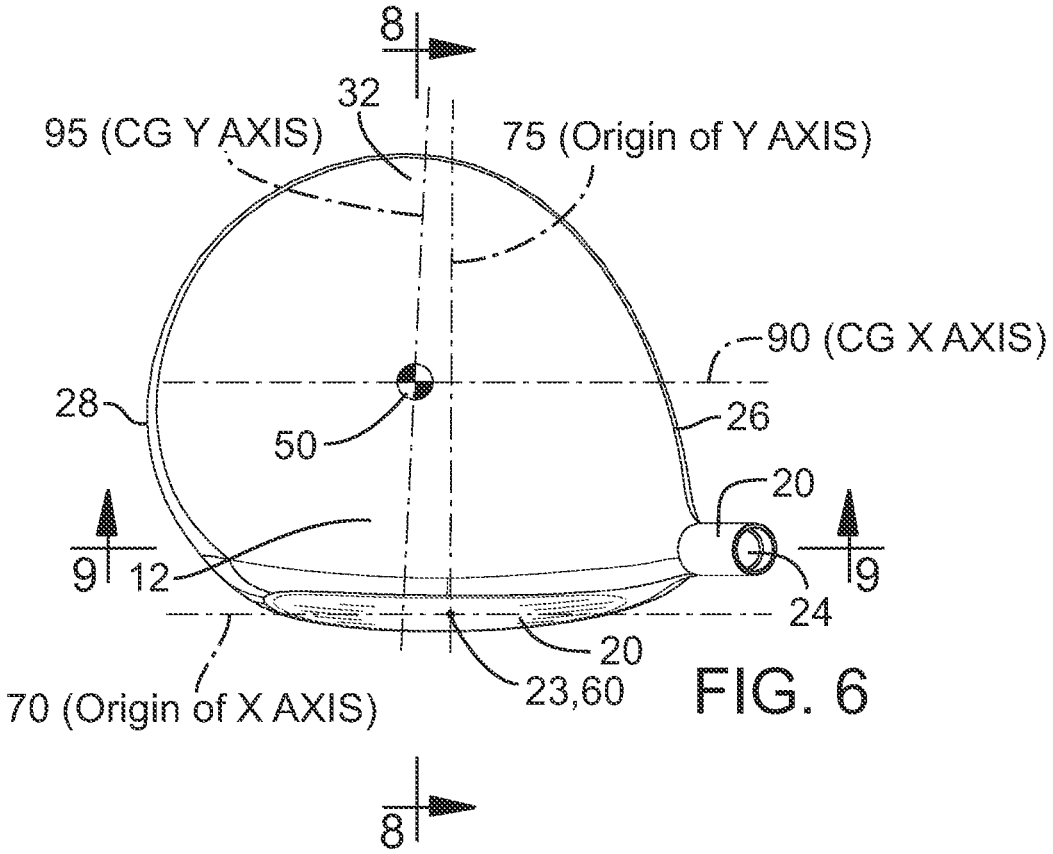
FIG. 6 is a top plan view of the golf club head of FIG. 1.

The crown 12 is defined as an upper portion of the club head (1) above a peripheral outline 34 of the club head as viewed from a top-down direction; and (2) rearwards of the topmost portion of a ball striking surface 22 of the striking face 18 (see FIG. 6). The striking surface 22 is defined as a front or external surface of the striking face 18 and is adapted for impacting a golf ball (not shown). In several embodiments, the striking face or face portion 18 can be a striking plate attached to the body 10 using conventional attachment techniques, such as welding, as will be described in more detail below. In some embodiments, the striking surface 22 can have a bulge and roll curvature. For example, referring to FIG. 30, the striking surface 22 can have a bulge and roll each with a radius of approximately 305 mm.

The sole 14 is defined as a lower portion of the club head 2 extending upwards from a lowest point of the club head when the club head is ideally positioned, i.e., at a proper address position relative to a golf ball on a level surface. In some implementations, the sole 14 extends approximately 50% to 60% of the distance from the lowest point of the club head to the crown 12, which in some instances, can be approximately 15 mm for a driver and between approximately 10 mm and 12 mm for a fairway wood.

A golf club head, such as the club head 2, is at its proper address position when angle 15 (see FIG. 1) is approximately equal to the golf club head loft and when the golf club head lie angle 19 (see FIG. 2) is approximately equal to 60 degrees. Angle 15 is the angle defined between a face plane 27, defined as the plane tangent to an ideal impact location 23 on the striking surface 22, and a vertical plane 29 relative to the ground 17. Lie angle 19 is the angle defined between a longitudinal axis 21 of the hosel 20 or shaft and the ground 17. The ground, as used herein, is assumed to be a level plane.

The skirt 16 includes a side portion of the club head 2 between the crown 12 and the sole 14 that extends across a periphery 34 of the club head, excluding the striking surface 22, from the toe portion 28, around the rear portion 32, to the heel portion 26.

Figure 4:
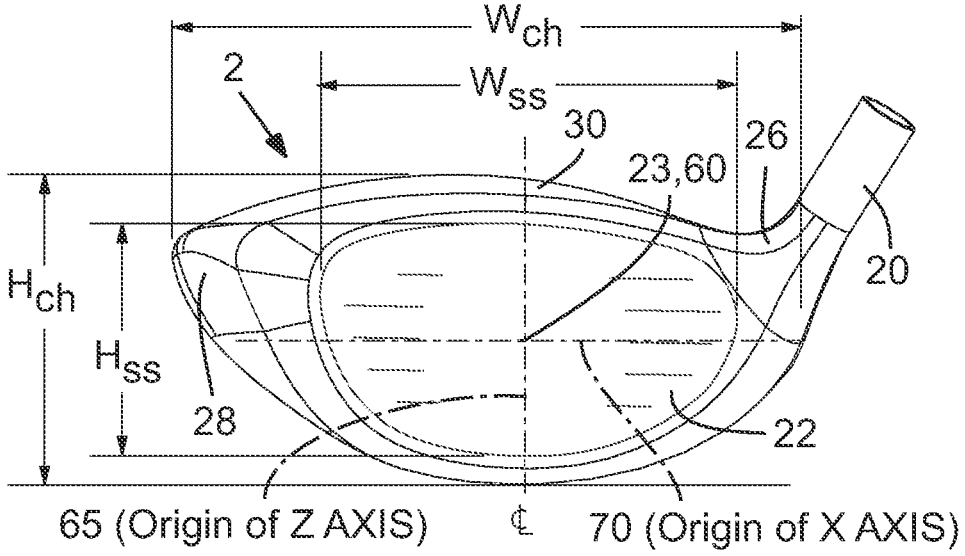
FIG. 4 is a front elevation view of the golf club head of FIG. 1 showing a golf club head origin coordinate system.

In the illustrated embodiment, the ideal impact location 23 of the golf club head 2 is disposed at the geometric center of the striking surface 22 (see FIG. 4). The striking surface 22 is typically defined as the intersection of the midpoints of a height ($H_{ss}$) and width ($W_{ss}$) of the striking surface. See USGA "Procedure for Measuring the Flexibility of a Golf Clubhead," Revision 2.0. In some implementations, the golf club head 2 has a height ($H_{ss}$) between approximately 50 mm and approximately 65 mm, and a width ($W_{ss}$) between approximately 80 mm and approximately 100 mm. Referring to FIG. 30, in one specific implementation, the golf club head 2 has a height ($H_{ss}$) of approximately 58.6 mm, width ($W_{ss}$) of approximately 90.6 mm, and total striking surface area of approximately 3,929 $mm^2$.

In some embodiments, the striking face 18 is made of a composite material such as described in U.S. Patent Application Publication Nos. 2005/0239575 and 2004/0235584, U.S. patent application Ser. No. 11/642,310, and U.S. Provisional Patent Application No. 60/877,336, which are incorporated herein by reference. In other embodiments, the striking face 18 is made from a metal alloy (e.g., titanium, steel, aluminum, and/or magnesium), ceramic material, or a combination of composite, metal alloy, and/or ceramic materials. Further, the striking face 18 can be a striking plate having a variable thickness such as described in U.S. Pat. No. 6,997,820, which is incorporated herein by reference.

The crown 12, sole 14, and skirt 16 can be integrally formed using techniques such as molding, cold forming, casting, and/or forging and the striking face 18 can be attached to the crown, sole and skirt by means known in the art. For example, the striking face 18 can be attached to the body 10 as described in U.S. Patent Application Publication Nos. 2005/0239575 and 2004/0235584. The body 10 can be made from a metal alloy (e.g., titanium, steel, aluminum, and/or magnesium), composite material, ceramic material, or any combination thereof. The wall 72 of the golf club head 2 can be made of a thin-walled construction, such as described in U.S. application Ser. No. 11/067,475, filed Feb. 25, 2005, which is incorporated herein by reference. For example, in some implementations, the wall can have a thickness between approximately 0.65 mm and approximately 0.8 mm. In one specific implementation, the wall 72 of the crown 12 and skirt 16 has a thickness of approximately 0.65 mm, and the wall of the sole 14 has a thickness of approximately 0.8 mm.

Figure 5:
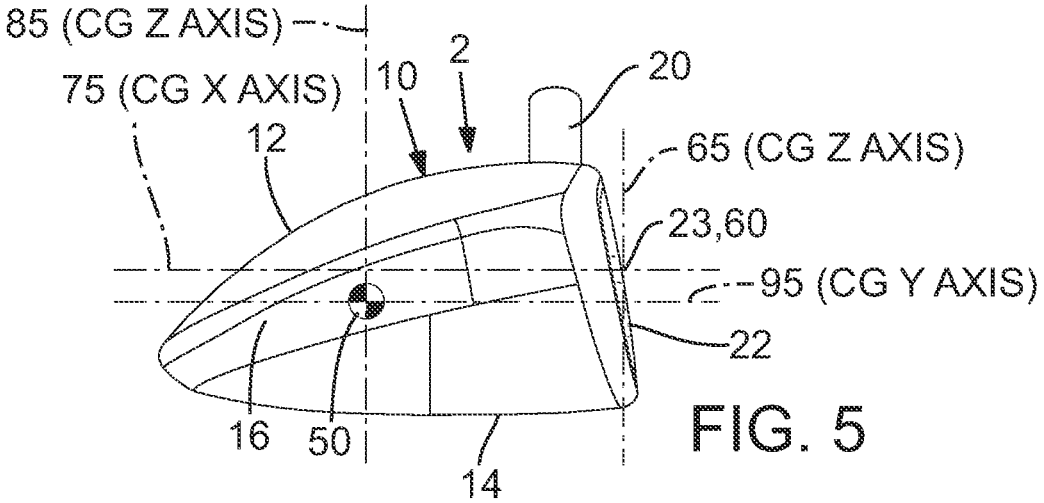
FIG. 5 is a side elevation view of the golf club head of FIG. 1 showing a center of gravity coordinate system.

A club head origin coordinate system may be defined such that the location of various features of the club head (including, e.g., a club head center-of-gravity (CG) 50 (see FIGS. 5 and 6)) can be determined. Referring to FIGS. 4-6, a club head origin 60 is represented on club head 2. The club head origin 60 is positioned at the ideal impact location 23, or geometric center, of the striking surface 22.

Referring to FIGS. 5 and 6, the head origin coordinate system, as defined with respect to the head origin 60, includes three axes: a z-axis 65 extending through the head origin 60 in a generally vertical direction relative to the ground 17 when the club head 2 is at the address position; an x-axis 70 extending through the head origin 60 in a toe-to-heel direction generally parallel to the striking surface 22, i.e., generally tangential to the striking surface 22 at the ideal impact location 23, and generally perpendicular to the z-axis 65; and a y-axis 75 extending through the head origin 60 in a front-to-back direction and generally perpendicular to the x-axis 70 and to the z-axis 65. The x-axis 70 and the y-axis 75 both extend in generally horizontal directions relative to the ground 17 when the club head 2 is at the address position. The x-axis 70 extends in a positive direction from the origin 60 to the heel 26 of the club head 2. The y-axis 75 extends in a positive direction from the origin 60 towards the rear portion 32 of the club head 2. The z-axis 65 extends in a positive direction from the origin 60 towards the crown 12.

In one embodiment, the golf club head can have a CG with an x-axis coordinate between approximately −2 mm and approximately 6 mm, a y-axis coordinate between approximately 33 mm and approximately 41 mm, and a z-axis coordinate between approximately −7 mm and approximately 1 mm. Referring to FIG. 30, in one specific implementation, the CG x-axis coordinate is approximately 1.8 mm, the CG y-axis coordinate is approximately 37.1 mm, and the CG z-axis coordinate is approximately −3.26 mm.

Referring to FIG. 4, club head 2 has a maximum club head height ($H_{ch}$) defined as the distance between the lowest and highest points on the outer surface of the body 10 measured along an axis parallel to the z-axis when the club head 2 is at proper address position; a maximum club head width ($W_{ch}$) defined as the distance between the maximum extents of the heel and toe portions 26, 28 of the body measured along an axis parallel to the x-axis when the club head 2 is at proper address position; and a maximum club head depth ($D_{ch}$), or length, defined as the distance between the forwardmost and rearwardmost points on the surface of the body 10 measured along an axis parallel to the y-axis when the club head 2 is at proper address position. The height and width of club head 2 is measured according to the USGA "Procedure for Measuring the Clubhead Size of Wood Clubs" Revision 1.0. In some implementations, the golf club head 2 has a height ($H_{ch}$) between approximately 55 mm and approximately 75 mm, a width ($W_{ch}$) between approximately 110 mm and approximately 130 mm, and a depth ($D_{ch}$) between approximately 110 mm and approximately 130 mm. Referring to FIG. 30, in one specific implementation, the golf club head 2 has a height ($H_{ch}$) of approximately 60.7 mm, width ($W_{ch}$) of approximately 120.5 mm, and depth ($D_{ch}$) of approximately 115 mm.

In certain embodiments, the club head 2 includes a rib 82 extending along an interior surface of the sole 14 and skirt 16 generally parallel to the striking face 18. In some instances, the rib 82 provides structural rigidity to the club head 2 and vibrational dampening. Although club head 2 includes a single rib 82, in some implementations, the club head 2 includes multiple ribs 82. Further, in some implementations, the rib 82 extends along only the sole 14 or includes two spaced-apart portions each extending along the skirt 16 on separate sides of the club head.

Referring to FIGS. 5 and 6, golf club head moments of inertia are typically defined about three axes extending through the golf club head CG 50: (1) a CG z-axis 85 extending through the CG 50 in a generally vertical direction relative to the ground 17 when the club head 2 is at address position; (2) a CG x-axis 90 extending through the CG 50 in a heel-to-toe direction generally parallel to the striking surface 22 and generally perpendicular to the CG z-axis 85; and (3) a CG y-axis 95 extending through the CG 50 in a front-to-back direction and generally perpendicular to the CG x-axis 90 and the CG z-axis 85. The CG x-axis 90 and the CG y-axis 95 both extend in a generally horizontal direction relative to the ground 17 when the club head 2 is at the address position.

A moment of inertia about the golf club head CG x-axis 90 is calculated by the following equation $$Ixx=\int(y^2+z^2)dm \quad (1)$$

where y is the distance from a golf club head CG xz-plane to an infinitesimal mass dm and z is the distance from a golf club head CG xy-plane to the infinitesimal mass dm. The golf club head CG xz-plane is a plane defined by the golf club head CG x-axis 90 and the golf club head CG z-axis 85. The CG xy-plane is a plane defined by the golf club head CG x-axis 90 and the golf club head CG y-axis 95.

A moment of inertia about the golf club head CG z-axis 85 is calculated by the following equation $$Izz=\int(x^2+y^2)dm \quad (2)$$

where x is the distance from a golf club head CG yz-plane to an infinitesimal mass dm and y is the distance from the golf club head CG xz-plane to the infinitesimal mass dm. The golf club head CG yz-plane is a plane defined by the golf club head CG y-axis 95 and the golf club head CG z-axis 85.

As the moment of inertia about the CG z-axis (Izz) is an indication of the ability of a golf club head to resist twisting about the CG z-axis, the moment of inertia about the CG x-axis (Ixx) is an indication of the ability of the golf club head to resist twisting about the CG x-axis. The higher the moment of inertia about the CG x-axis (Ixx), the greater the forgiveness of the golf club head on high and low off-center impacts with a golf ball. In other words, a golf ball hit by a golf club head on a location of the striking surface 18 above the ideal impact location 23 causes the golf club head to twist upwardly and the golf ball to have a higher launch angle and lower spin than desired. Similarly, a golf ball hit by a golf club head on a location of the striking surface 18 below the ideal impact location 23 causes the golf club head to twist downwardly and the golf ball to have a lower launch angle and higher spin than desired. Both high and low off-center hits also cause loss of ball speed compared to centered hits. Increasing the moment of inertia about the CG x-axis (Ixx) reduces upward and downward twisting of the golf club head to reduce the negative effects of high and low off-center impacts.

As discussed above, many conventional golf club heads are designed to achieve a moment of inertia about the CG z-axis (Izz) that approaches the maximum moment of inertia allowable by the USGA in order to increase straightness of the shot and reduce ball speed-loss, i.e., forgiveness on heel and toe off-center hits. However, few, if any, conventional golf club heads are designed to achieve a high moment of inertia about the CG x-axis (Ixx) in conjunction with a high moment of inertia about the CG z-axis (Izz). Moreover, the prior art does not recognize the need to, nor the advantages associated with, configuring a golf club head to have an increased moment of inertia about the CG x-axis (Ixx) while maintaining a specific ratio of the moment of inertia about the CG x-axis (Ixx) to the moment of inertia about the CG z-axis, i.e., Ixx/Izz.

Increasing the moment of inertia about the CG x-axis (Ixx) typically does not involve distributing additional mass away from the hosel and shaft. Accordingly, the moment of inertia about the CG x-axis (Ixx) can be increased without significantly affecting the ability of a golfer to square the club head at impact. Therefore, a golf club head can have a moderately high moment of inertia about the CG z-axis (Izz) and an increased moment of inertia about the CG x-axis (Ixx) to provide a golf club head with a high forgiveness on high, low, heel and toe off-center impacts without negatively impacting a golfer's ability to square the golf club head. Further, a given head design offers only so much discretionary mass that can be used to achieve specific moments of inertia, e.g., moment of inertia about the CG x-axis (Ixx) and/or moment of inertia about the CG z-axis (Izz). Thus, it is often not desirable to utilize all or most of the discretionary mass to achieve a selected moment of inertia about the CG z-axis (Izz), in part because increases in moment of inertia about the CG z-axis (Izz) beyond about 500 $kg \cdot mm^2$ accrue proportionately less benefit. In such instances, it is often desirable to maintain moment of inertia about the CG z-axis (Izz) and redistribute mass to achieve an increase in moment of inertia about the CG x-axis (Ixx) and thus an increase in the ratio of moment of inertia about the CG x-axis (Ixx) to moment of inertia about the CG z-axis (Izz).

As moments of inertia are proportional to the square of the distance of the mass away from an axis of rotation, according to several embodiments, golf club heads described herein can include one or more localized or discrete mass elements positioned at strategic locations about the golf club head to affect the moments of the inertia of the head without increasing the bulk of the golf club head. Further, in some embodiments, using localized or discrete mass elements in conjunction with body a made of a thin-walled construction can provide desirable mass properties without the need for composite materials, which can lead to increased material and manufacturing costs.

Figure 7:
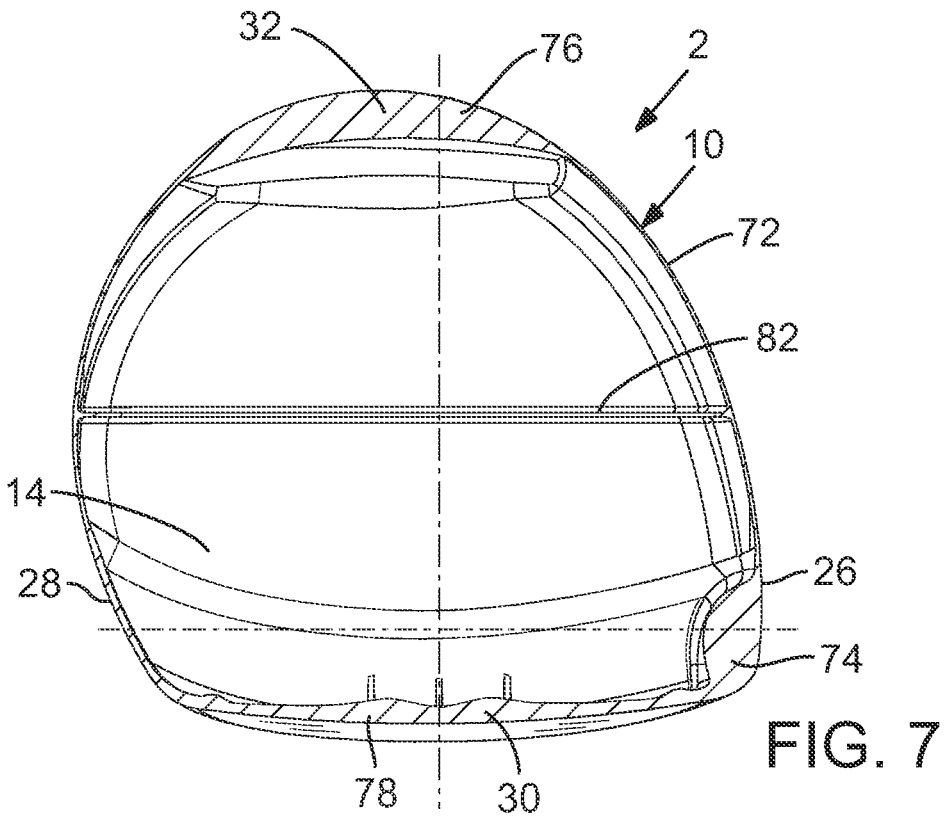
FIG. 7 is a cross-sectional view of the golf club head of FIG. 1 taken along the line 6-6 of FIG. 1.
Figure 8:
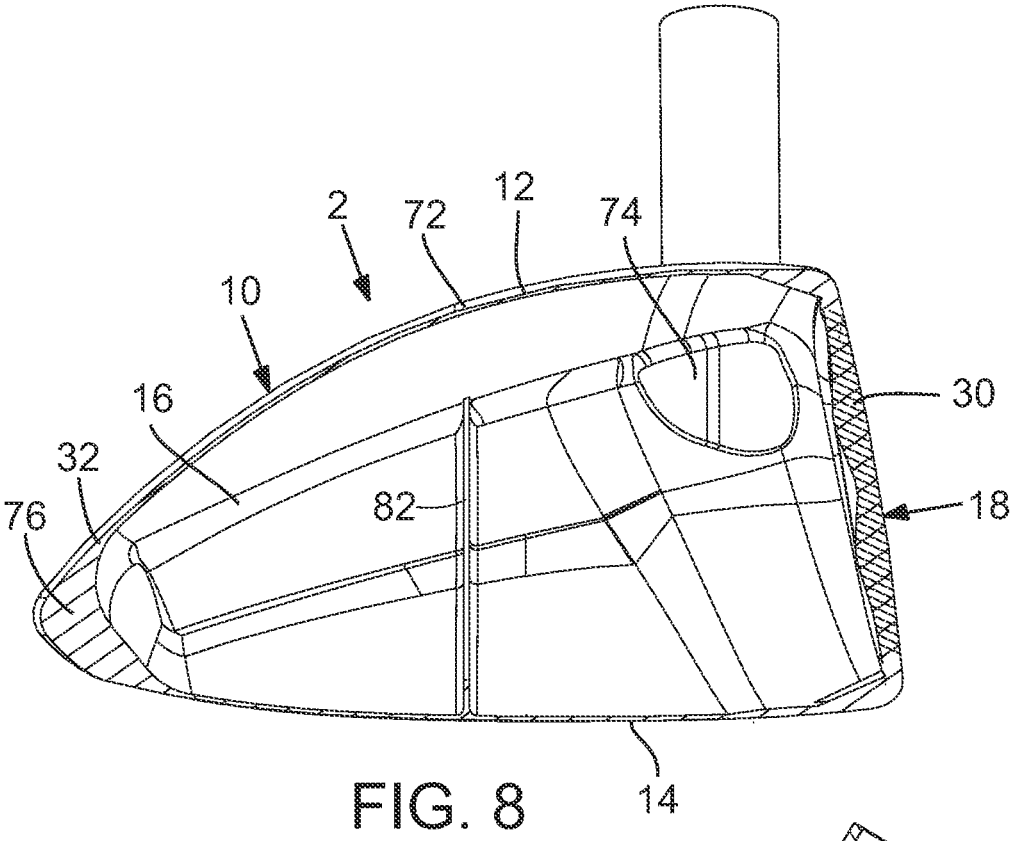
FIG. 8 is a cross-sectional side view of the golf club head of FIG. 1 taken along the line 8-8 of FIG. 6 and shown without the hosel.
Figure 9:
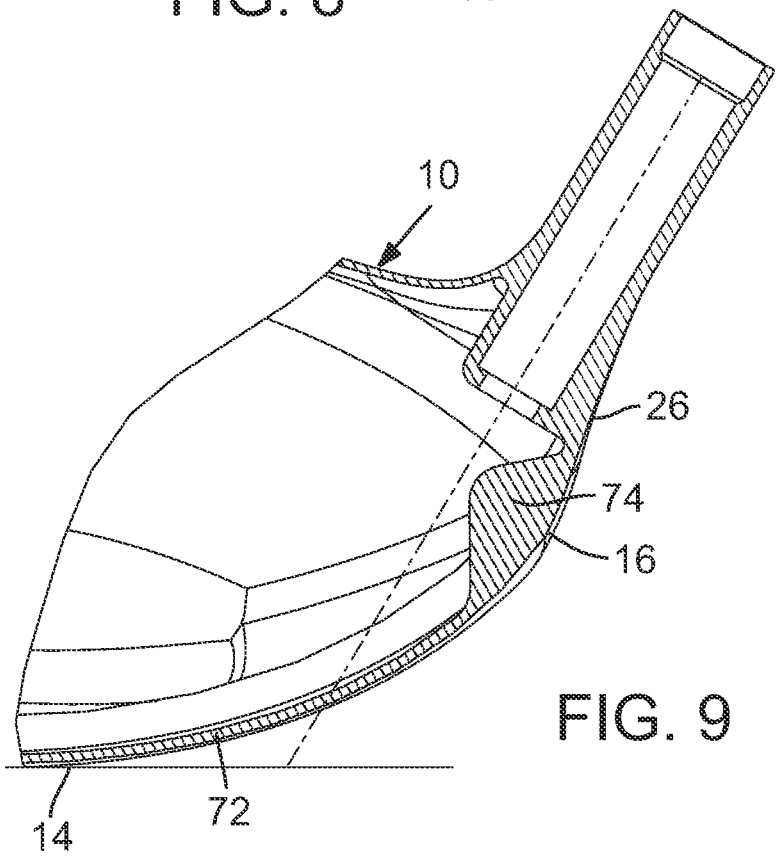
FIG. 9 is a cross-sectional detailed view of the golf club head of FIG. 1 taken along the line 9-9 of FIG. 6 showing a heel mass element.
Figure 10:
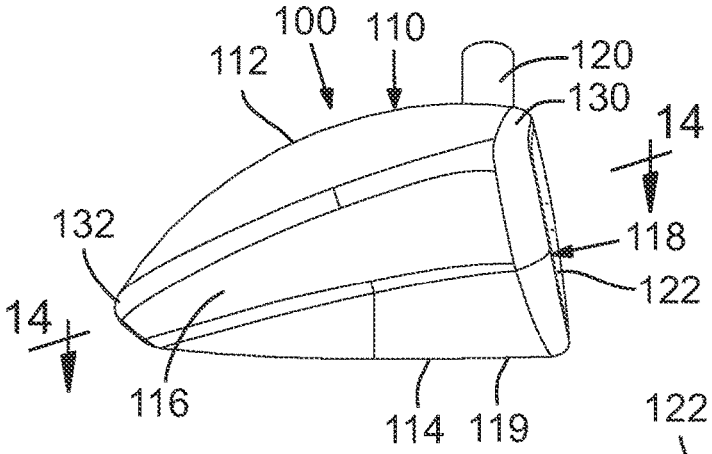
FIG. 10 is a side elevation view of a golf club head according to a second embodiment.
Figure 11:
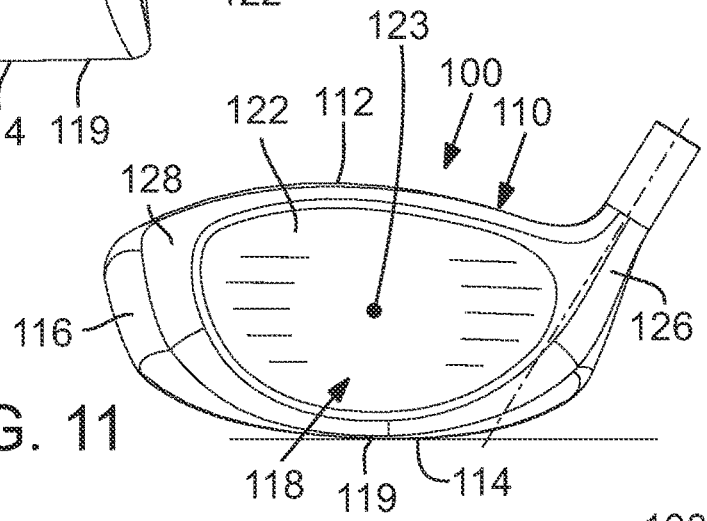
FIG. 11 is a front elevation view of the golf club head of FIG. 10.
Figure 12:
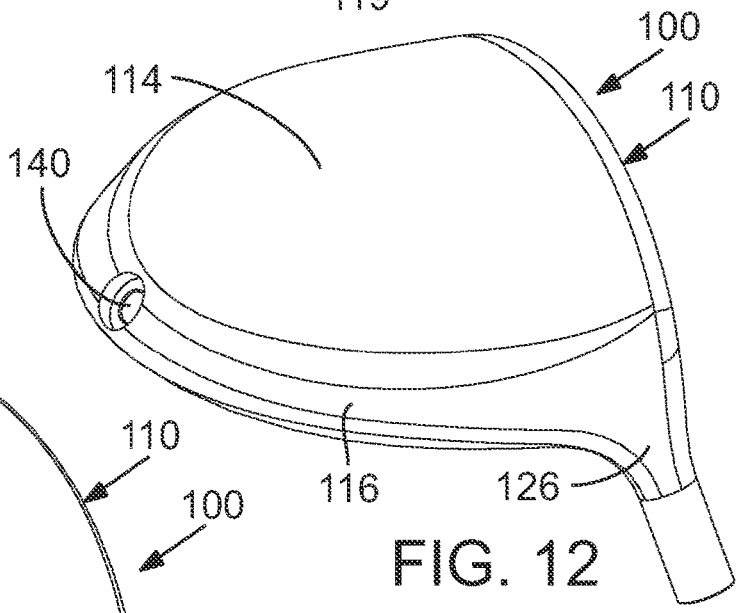
FIG. 12 is a bottom perspective view of the golf club head of FIG. 10.
Figure 13:
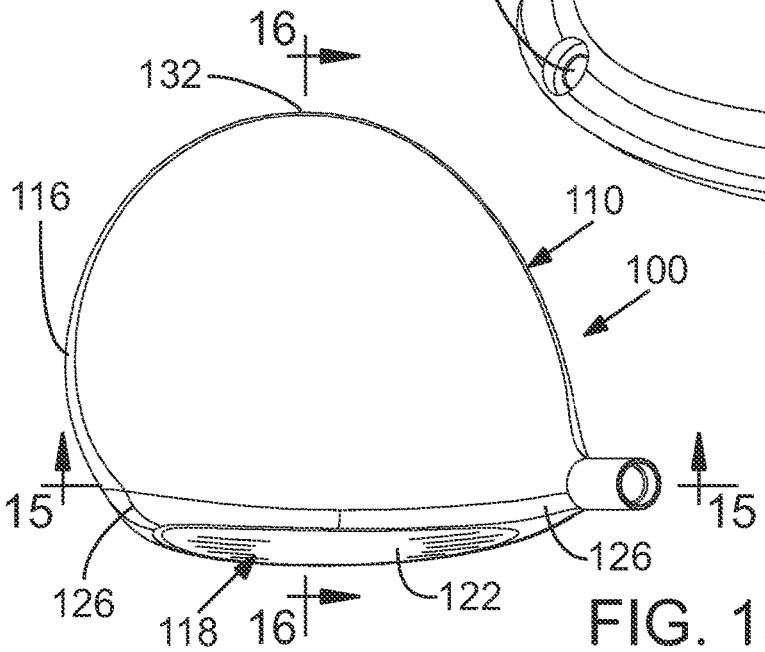
FIG. 13 is a top plan view of the golf club head of FIG. 10.

Referring to FIGS. 7-9, golf club 2 includes a localized heel mass element 74 and rear mass element 76. A mass element can be defined as an individual structure having a mass, or a plurality of localized structures each having a mass, secured to a wall of a golf club head or integrally formed as a one-piece construction with and extending from the wall of a golf club head. Although an integrally formed mass element can be described as a build-up of wall thickness, a portion of the built-up wall thickness contiguous with, and having the same general thickness as, the wall surrounding the mass element does not form part of the mass element, and thus is not included in the mass or center of gravity determination of the mass element.

The mass elements 74, 76 can be positioned within the interior cavity 79 and secured to, or be formed integrally with, respective inner surfaces of wall 72 or striking face 18. As shown, the mass elements 74, 76 are formed integrally with, and extend inwardly from, wall 72 or striking face 18 of body 10 to form a localized area of increased or built-up wall thickness. The heel mass element 74 is positioned on the skirt 14 at the heel portion 26 of the golf club head 2 proximate the front portion 30. The rear mass element 76 extends inwardly from the sole 14, skirt 16, and crown 12 and is positioned proximate the rear portion 32 of the golf club head 2.

The location of each mass element 74, 76 on the golf club head can be defined as the location of the center of gravity of the mass element relative to the club head origin coordinate system. For example, in some implementations, the heel mass element 74 has an origin x-axis coordinate between approximately 35 mm and approximately 65 mm, an origin y-axis coordinate between approximately 0 mm and approximately 30 mm, and an origin z-axis coordinate between approximately −20 mm and approximately 10 mm. In one specific implementation, the heel mass element 74 has an origin x-axis coordinate of approximately 50 mm, an origin y-axis coordinate of approximately 15 mm, and an origin z-axis coordinate of approximately −3 mm. Similarly, in some implementations, the rear mass element 76 has an origin x-axis coordinate between approximately −20 mm and approximately 10 mm, an origin y-axis coordinate between approximately 90 mm and approximately 120 mm, and an origin z-axis coordinate between approximately −20 mm and approximately 10 mm. In one specific implementation, the rear mass element 76 has an origin x-axis coordinate of approximately −7 mm, an origin y-axis coordinate of approximately 106 mm, and an origin z-axis coordinate of approximately −3 mm.

Further, the mass elements 74, 76 can have any one of various masses. For example, in some implementations, the heel mass element 74 has a mass between about 3 g and about 23 g and the rear mass element 76 has a mass between about 15 g and about 35 g. In one specific implementation, the heel mass element 74 has a mass of approximately 6 g and the rear mass element 76 has a mass of approximately 24 g.

The configuration of the golf club head 2, including the locations and mass of the mass elements 74, 76, can, in some implementations, result in the club head 2 having a moment of inertia about the CG z-axis (Izz) between about 450 $kg \cdot mm^2$ and about 600 $kg \cdot mm^2$, and a moment of inertia about the CG x-axis (Ixx) between about 280 $kg \cdot mm^2$ and about 400 $kg \cdot mm^2$. In one specific implementation having the mass element locations and masses indicated in FIG. 30, club head 2 has a moment of inertia about the CG z-axis (Izz) of approximately 528 $kg \cdot mm^2$ and a moment of inertia about the CG x-axis (Ixx) of approximately 339 $kg \cdot mm^2$. In this implementation, then, the ratio of Ixx/Izz is approximately 0.64. However, in other implementations, the ratio of Ixx/Izz is between about 0.5 $kg \cdot mm^2$ and about 0.9 $kg \cdot mm^2$.

Referring to FIGS. 10-16, and according to another exemplary embodiment, golf club head 100 has a body 110 with a crown 112, sole 114, skirt 116, and striking face 118 defining an interior cavity 157. The body 110 further includes a hosel 120, heel portion 126, a toe portion 128, a front portion 130, a rear portion 132, and an internal rib 182. The striking face 118 includes an outwardly facing ball striking surface 122 having an ideal impact location at a geometric center 123 of the striking surface. In some implementations, the golf club head 100 has a volume between approximately 420 $cm^3$ and approximately 480 $cm^3$, and a total mass between approximately 190 g and approximately 210 g. Referring to FIG. 30, in one specific implementation, the golf club head 100 has a volume of approximately 454 $cm^3$ and a total mass of approximately 202.8 g.

Unless otherwise noted, the general details and features of the body 110 of golf club head 100 can be understood with reference to the same or similar features of the body 10 of golf club head 2.

The sole 114 extends upwardly from the lowest point of the golf club head 100 a shorter distance than the sole 14 of golf club head 2. For example, in some implementations, the sole 114 extends upwardly approximately 20% to 40% of the distance from the lowest point of the club head 100 to the crown 112, which in some instances, can be approximately 15 mm for a driver and between approximately 10 mm and approximately 12 mm for a fairway wood. Further, the sole 114 comprises a substantially flat portion 119 extending horizontal to the ground 117 when in proper address position. In some implementations, the bottommost portion of the sole 114 extends substantially parallel to the ground 117 between approximately 70% and approximately 40% of the depth ($D_{ch}$) of the golf club head 100.

Because the sole 114 of golf club head 100 is shorter than the sole 12 of golf club head 2, the skirt 116 is taller, i.e., extends a greater approximately vertical distance, than the skirt 16 of golf club head 2. In at least one implementation, the golf club head 100 includes a weight port 140 formed in the skirt 116 proximate the rear portion 132 of the club head (see FIG. 12). The weight port 140 can have any of a number of various configurations to receive and retain any of a number of weights or weight assemblies, such as described in U.S. patent application Ser. Nos. 11/066,720 and 11/065,772, which are incorporated herein by reference.

In some implementations, the striking surface 122 golf club head 100 has a height ($H_{ss}$) between approximately 50 mm and approximately 65 mm, and a width ($W_{ss}$) between approximately 80 mm and approximately 100 mm. Referring to FIG. 30, in one specific implementation, the golf club head 100 has a height ($H_{ss}$) of approximately 59.6 mm, width ($W_{ss}$) of approximately 90.6 mm, and total striking surface area of approximately 4,098 $mm^2$.

In one embodiment, the golf club head 100 has a CG with an x-axis coordinate between approximately −2 mm and approximately 6 mm, a y-axis coordinate between approximately 33 mm and approximately 41 mm, and a z-axis coordinate between approximately −8 mm and approximately 0 mm. Referring to FIG. 30, in one specific implementation, the CG x-axis coordinate is approximately 2.0 mm, the CG y-axis coordinate is approximately 37.9 mm, and the CG z-axis coordinate is approximately −4.67 mm.

In some implementations, the golf club head 100 has a height ($H_{ch}$) between approximately 55 mm and approximately 75 mm, a width ($W_{ch}$) between approximately 110 mm and approximately 130 mm, and a depth ($D_{ch}$) between approximately 110 mm and approximately 130 mm. Referring to FIG. 30, in one specific implementation, the golf club head 100 has a height ($H_{ch}$) of approximately 62.2 mm, width ($W_{ch}$) of approximately 119.3 mm, and depth ($D_{ch}$) of approximately 110.7 mm.

Figure 14:
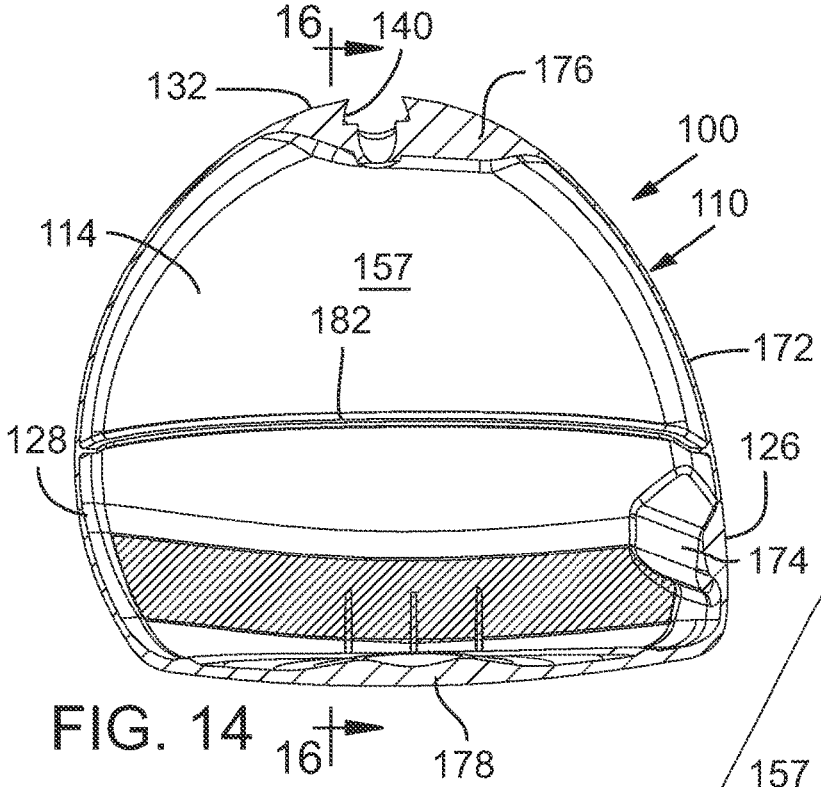
FIG. 14 is a cross-sectional view of the golf club head of FIG. 10 taken along the line 14-14 of FIG. 10.
Figure 15:
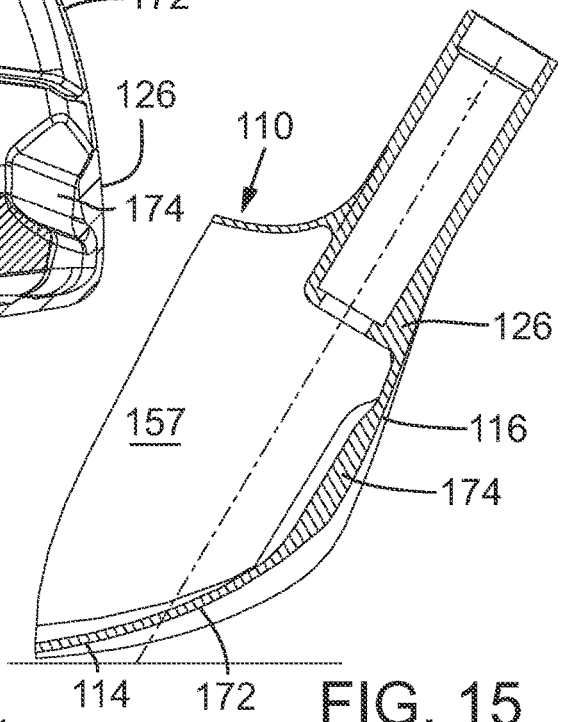
FIG. 15 is a cross-sectional detailed view of the golf club head of FIG. 1 taken along the line 15-15 of FIG. 13.
Figure 16:
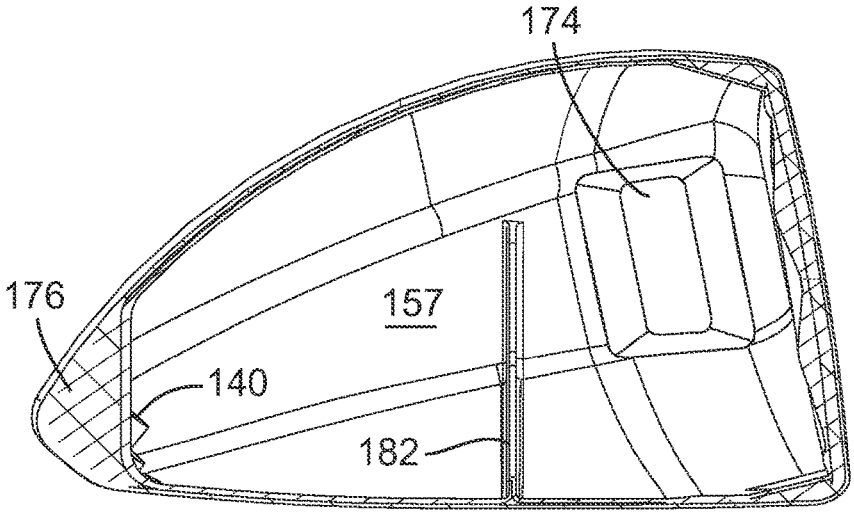
FIG. 16 is a cross-sectional side view of the golf club head of FIG. 1 taken along the line 16-16 of FIG. 14 and shown without the hosel.
Figure 17:
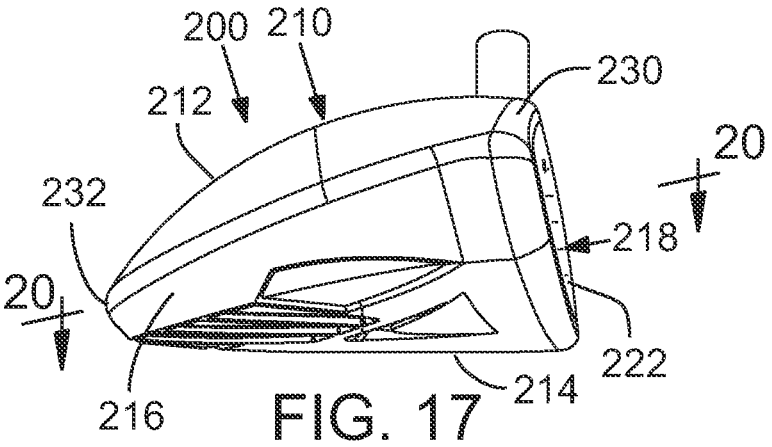
FIG. 17 is a side elevation view of a golf club head according to a third embodiment.

Referring to FIGS. 14-16, golf club head 100 includes a localized heel mass element 174 and rear mass element 176. In some implementations, the heel mass element 174 has an origin x-axis coordinate between approximately 35 mm and approximately 65 mm, an origin y-axis coordinate between approximately 10 mm and approximately 40 mm, and an origin z-axis coordinate between approximately −25 mm and approximately 5 mm. In one specific implementation, the heel mass element 174 has an origin x-axis coordinate of approximately 50 mm, an origin y-axis coordinate of approximately 25 mm, and an origin z-axis coordinate of approximately −10 mm. Similarly, in some implementations, the rear mass element 176 has an origin x-axis coordinate between approximately −15 mm and approximately 15 mm, an origin y-axis coordinate between approximately 90 mm and approximately 120 mm, and an origin z-axis coordinate between approximately −20 mm and approximately 10 mm. In one specific implementation, the rear mass element 176 has an origin x-axis coordinate of approximately 0 mm, an origin y-axis coordinate of approximately 103 mm, and an origin z-axis coordinate of approximately −4 mm.

Like mass elements 74, 76, the mass elements 174, 176 can have any one of various masses. For example, in some implementations, the heel mass element 174 has a mass between about 3 g and about 23 g and the rear mass element 176 has a mass between about 10 g and about 30 g. In one specific implementation, the heel mass element 174 has a mass of approximately 6 g and the rear mass element 176 has a mass of approximately 19 g.

The configuration of the golf club head 100, including the locations and mass of the mass elements 174, 176, can, in some implementations, result in the club head having a moment of inertia about the CG z-axis (Izz) between about 450 kg·mm$^2$ and about 600 kg·mm$^2$, and a moment of inertia about the CG x-axis (Ixx) between about 280 kg·mm$^2$ and about 400 kg·mm$^2$. In one specific implementation having mass element locations and masses indicated in FIG. 30, club head 100 has a moment of inertia about the CG z-axis (Izz) of approximately 498 kg·mm$^2$ and a moment of inertia about the CG x-axis (Ixx) of approximately 337 kg·mm$^2$. In this implementation, then, the ratio of Ixx/Izz is approximately 0.68. However, in other implementations, the ratio of Ixx/Izz is between about 0.5 and about 0.9.

Referring to FIGS. 17-21, and according to another exemplary embodiment, golf club head 200 has a body 210 with a low skirt similar to body 110 of golf club head 100. The body 210 includes a crown 212, a sole 214, a skirt 216, a striking face 218 defining an interior cavity 257. The body 210 further includes a hosel 220, heel portion 226, toe portion 228, front portion 230, and rear portion 232. The striking face 218 includes an outwardly facing ball striking surface 222 having an ideal impact location at a geometric center 223 of the striking surface. In some implementations, the golf club head 200 has a volume between approximately 420 cm$^3$ and approximately 480 cm$^3$, and a total mass between approximately 190 g and approximately 210 g. Referring to FIG. 30, in one specific implementation, the golf club head 200 has a volume of approximately 454 cm$^3$ and a total mass of approximately 202.8 g.

Unless otherwise noted, the general details and features of the body 210 of golf club head 200 can be understood with reference to the same or similar features of the body 10 of golf club head 2 and body 110 of golf club head 100.

Like sole 114 of golf club head 100, the sole 214 extends upwardly approximately 20% to 40% of the distance from the lowest point of the club head 200 to the crown 212. Therefore, the skirt 216 is taller, i.e., extends a greater approximately vertical distance, than the skirt 16 of golf club head 2.

Figure 18:
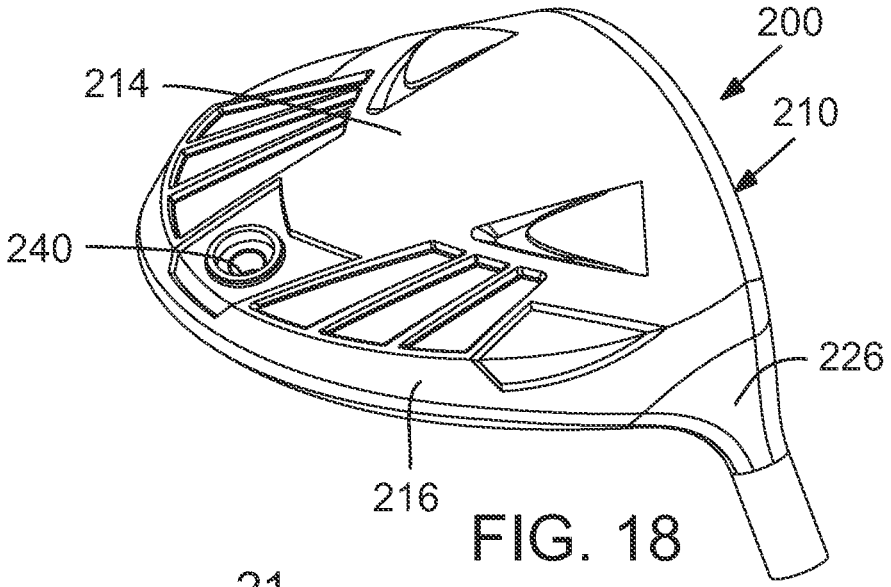
FIG. 18 is a bottom perspective view of the golf club head of FIG. 17.
Figure 19:
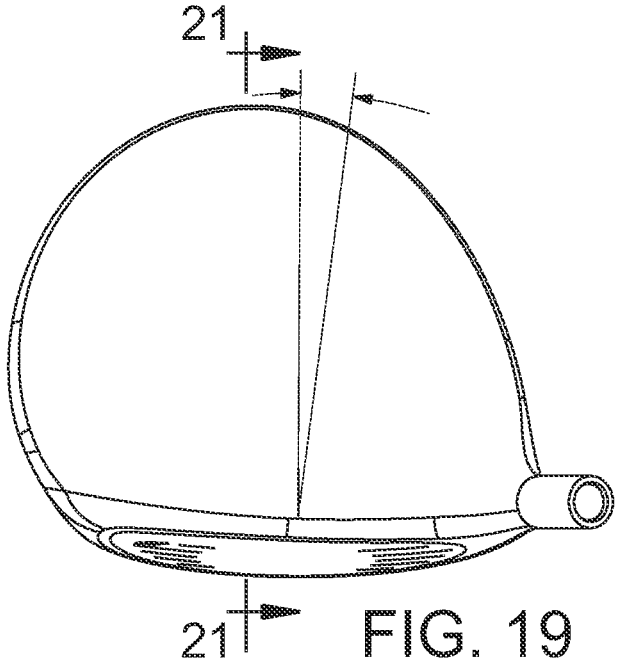
FIG. 19 is a top plan view of the golf club head of FIG. 17.
Figure 21:
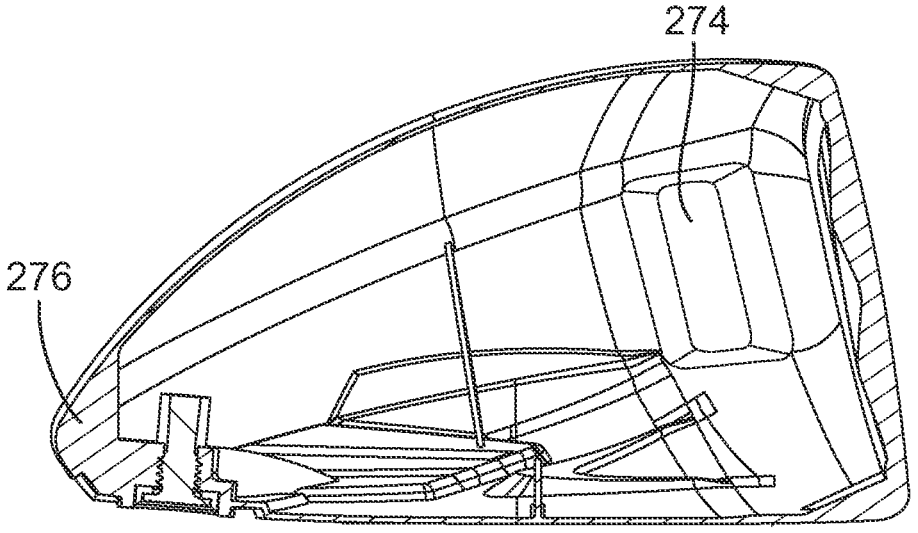
FIG. 21 is a cross-sectional side view of the golf club head of FIG. 17 taken along the line 21-21 of FIG. 19 and shown without the hosel.
Figure 22:
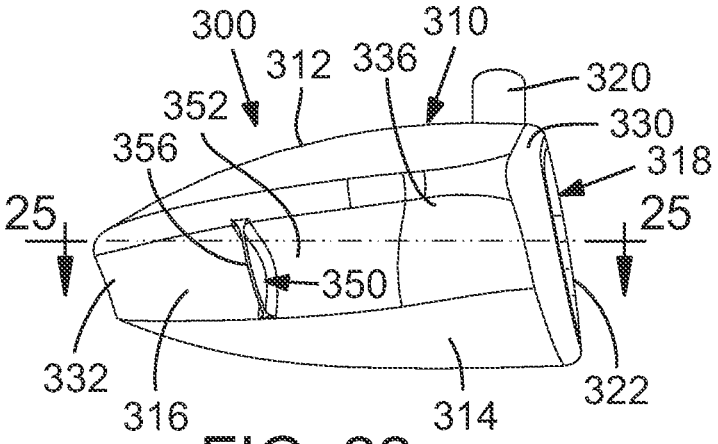
FIG. 22 is a side elevation view of a golf club head according to a fourth embodiment.
Figure 23:
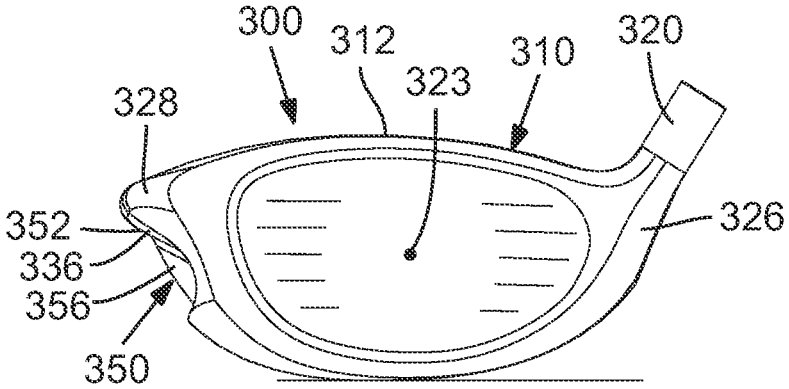
FIG. 23 is a front elevation view of the golf club head of FIG. 22.
Figure 24:
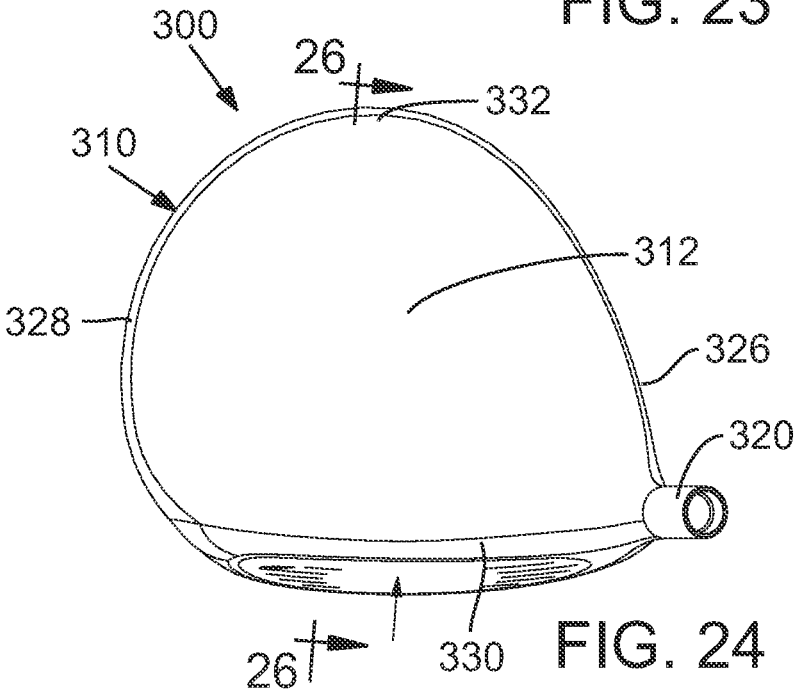
FIG. 24 is a top plan view of the golf club head of FIG. 22.

In at least one implementation, and shown in FIGS. 18 and 21, the golf club head 200 includes a weight port 240 formed in the sole 114 proximate the rear portion 232 of the club head. The weight port 240 can have any of a number of various configurations to receive and retain any of a number of weights or weight assemblies. For example, as shown, the weight port 240 extends substantially vertically from the wall 272 of the body 210 upwardly into the interior cavity 257.

In some implementations, the striking surface 222 golf club head 200 has a height ($H_{ss}$) between approximately 50 mm and approximately 65 mm, and a width ($W_{ss}$) between approximately 80 mm and approximately 100 mm. Referring to FIG. 30, in one specific implementation, the golf club head 200 has a height ($H_{ss}$) of approximately 56.8 mm, width ($W_{ss}$) of approximately 92.3 mm, and total striking surface area of approximately 4,100 mm$^2$.

In one embodiment, the golf club head 200 has a CG with an x-axis coordinate between approximately −2 mm and approximately 6 mm, a y-axis coordinate between approximately 33 mm and approximately 41 mm, and a z-axis coordinate between approximately −8 mm and approximately 0 mm. Referring to FIG. 30, in one specific implementation, the CG x-axis coordinate is approximately 2.3 mm, the CG y-axis coordinate is approximately 36.7 mm, and the CG z-axis coordinate is approximately −4.65 mm.

In some implementations, the golf club head 200 has a height ($H_{ch}$) between approximately 55 mm and approximately 75 mm, a width ($W_{ch}$) between approximately 110 mm and approximately 130 mm, and a depth ($D_{ch}$) between approximately 110 mm and approximately 130 mm. Referring to FIG. 30, in one specific implementation, the golf club head 200 has a height ($H_{ch}$) of approximately 61.5 mm, width ($W_{ch}$) of approximately 122.8 mm, and depth ($D_{ch}$) of approximately 113.5 mm.

Figure 20:
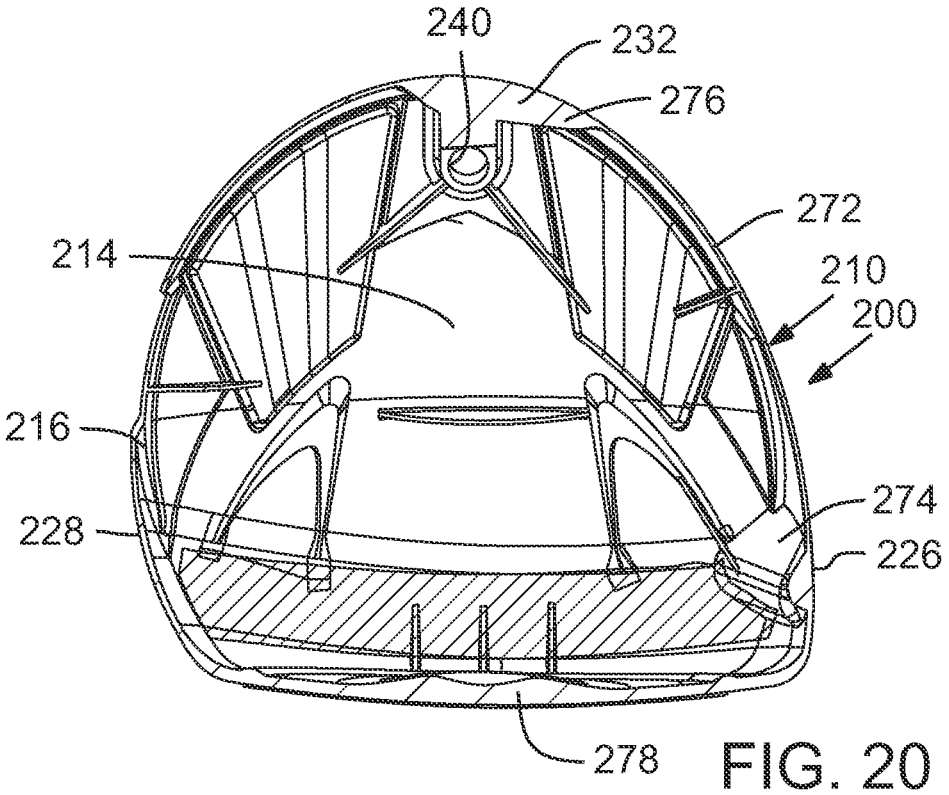
FIG. 20 is a cross-sectional view of the golf club head of FIG. 17 taken along the line 20-20 of FIG. 17.

Referring to FIGS. 20 and 21, golf club head 200 includes a localized heel mass element 274 and rear mass element 276. In some implementations, the heel mass element 274 has an origin x-axis coordinate between approximately 35 mm and approximately 65 mm, an origin y-axis coordinate between approximately 10 mm and approximately 40 mm, and an origin z-axis coordinate between approximately −15 mm and approximately 5 mm. In one specific implementation, the heel mass element 274 has an origin x-axis coordinate of approximately 50 mm, an origin y-axis coordinate of approximately 21 mm, and an origin z-axis coordinate of approximately −11 mm. Similarly, in some implementations, the rear mass element 276 has an origin x-axis coordinate between approximately −15 mm and approximately 15 mm, an origin y-axis coordinate between approximately 95 mm and approximately 125 mm, and an origin z-axis coordinate between approximately −30 mm and approximately 0 mm. In one specific implementation, the rear mass element 276 has an origin x-axis coordinate of approximately −1 mm, an origin y-axis coordinate of approximately 106 mm, and an origin z-axis coordinate of approximately −18 mm.

Like mass elements 74, 76, the mass elements 274, 276 can have any one of various masses or weights. For example, in some implementations, the heel mass element 274 has a mass between about 3 g and about 23 g and the rear mass element 276 has a mass between about 5 g and about 25 g. In one specific implementation, the heel mass element 274 has a mass of approximately 5 g and the rear mass element 276 has a mass of approximately 8 g.

The configuration of the golf club head 200, including the locations and mass of the mass elements 274, 276, can, in some implementations, result in the club head having a moment of inertia about the CG z-axis (Izz) between about 450 kg·mm$^2$ and about 600 kg·mm$^2$, and a moment of inertia about the CG x-axis (Ixx) between about 280 kg·mm$^2$ and about 400 kg·mm$^2$. In one specific implementation having mass element locations and masses indicated in FIG. 30, club head 200 has a moment of inertia about the CG z-axis (Izz) of approximately 495 kg·mm$^2$ and a moment of inertia about the CG x-axis (Ixx) of approximately 333 kg·mm$^2$. In this implementation, then, the ratio of Ixx/Izz is approximately 0.67. However, in other implementations, the ratio of Ixx/Izz is between about 0.5 and about 0.9.

Referring to FIGS. 22-26, and according to another exemplary embodiment, golf club head 300 has a body 310 that includes a crown 312, a sole 314, a skirt 316, a striking face 318 defining an interior cavity 357. The body 310 further includes a hosel 320, heel portion 326, toe portion 328, front portion 330, and rear portion 332. The striking face 318 includes an outwardly facing ball striking surface 322 having an ideal impact location at a geometric center 323 of the striking surface. The club head 300 also has a volume, typically measured in cubic-centimeters (cm$^3$), equal to the volumetric displacement of the club head 300. In some implementations, the golf club head 300 has a volume between approximately 420 cm$^3$ and approximately 480 cm$^3$, and a total mass between approximately 190 g and approximately 210 g. Referring to FIG. 30, in one specific implementation, the golf club head 300 has a volume of approximately 453 cm$^3$ and a total mass of approximately 202.3 g.

Unless otherwise noted, the general details and features of the body 310 of golf club head 300 can be understood with reference to the same or similar features of the body 10 of golf club head 2, body 110 of golf club head 100 and body 210 of golf club head 200.

Like soles 114, 214, the sole 314 extends upwardly approximately 20% to 40% of the distance from the lowest point of the club head 300 to the crown 312. Like skirts 116, 216, the skirt 316 is taller, i.e., extends a greater approximately vertical distance, than the skirt 16 of golf club head 2. However, unlike, skirts 116, 216, skirt 316 includes an inverted portion 352 having a substantially concave outer surface 336 extending about at least a substantial portion of the toe portion 328 of the golf club head 300.

Similar to the golf club head described in U.S. patent application Ser. No. 11/565,485, which is incorporated herein by reference, golf club head 300 includes a rib 350 that has an external portion 356 and two internal portions 358, 360 (see FIGS. 24 and 25). The external portion 356 is positioned along and projects from the external surface 336 of the concave portion 330. The internal portions 358, 360 are positioned within the internal cavity 357 of the body 302 and project from an internal surface 338 of the body. The external portion 356 is positioned between the first and second internal portions 358, 360 and is coupled to the internal portions via respective first and second rib transition regions (not shown) formed in a wall 372 of the body 310. Rib 350 extends generally parallel to a striking surface 322 of striking face 318 of the golf club head 300 along the toe portion 328 of the body 310. More specifically, the rib 350 extends along the toe portion 328 of the body 310 upwardly from the sole 314, along the skirt 316, to the crown 312.

In some implementations, the striking surface 322 golf club head 300 has a height ($H_{ss}$) between approximately 50 mm and approximately 65 mm, and a width ($W_{ss}$) between approximately 80 mm and approximately 100 mm. Referring to FIG. 30, in one specific implementation, the golf club head 300 has a height ($H_{ss}$) of approximately 57.2 mm, width ($W_{ss}$) of approximately 90.6 mm, and total striking surface area of approximately 3,929 mm$^2$.

In one embodiment, the golf club head 300 has a CG with an x-axis coordinate between approximately −2 mm and approximately 6 mm, a y-axis coordinate between approximately 33 mm and approximately 41 mm, and a z-axis coordinate between approximately −6 mm and approximately 2 mm. Referring to FIG. 30, in one specific implementation, the CG x-axis coordinate is approximately 3.3 mm, the CG y-axis coordinate is approximately 30.1 mm, and the CG z-axis coordinate is approximately −0.09 mm.

In some implementations, the golf club head 300 has a height ($H_{ch}$) between approximately 53 mm and approximately 73 mm, a width ($W_{ch}$) between approximately 105 mm and approximately 125 mm, and a depth ($D_{ch}$) between approximately 105 mm and approximately 125 mm. Referring to FIG. 30, in one specific implementation, the golf club head 300 has a height ($H_{ch}$) of approximately 59 mm, width ($W_{ch}$) of approximately 117.2 mm, and depth ($D_{ch}$) of approximately 117.2 mm.

Figure 25:
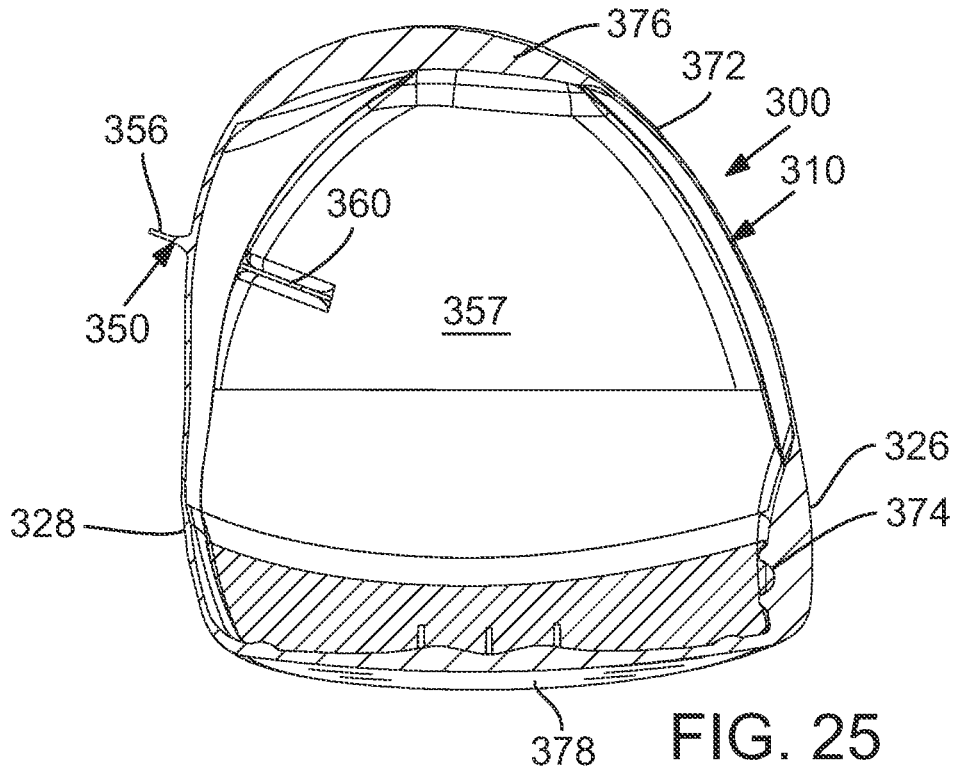
FIG. 25 is a cross-sectional view of the golf club head of FIG. 22 taken along the line 25-25 of FIG. 22.
Figure 26:
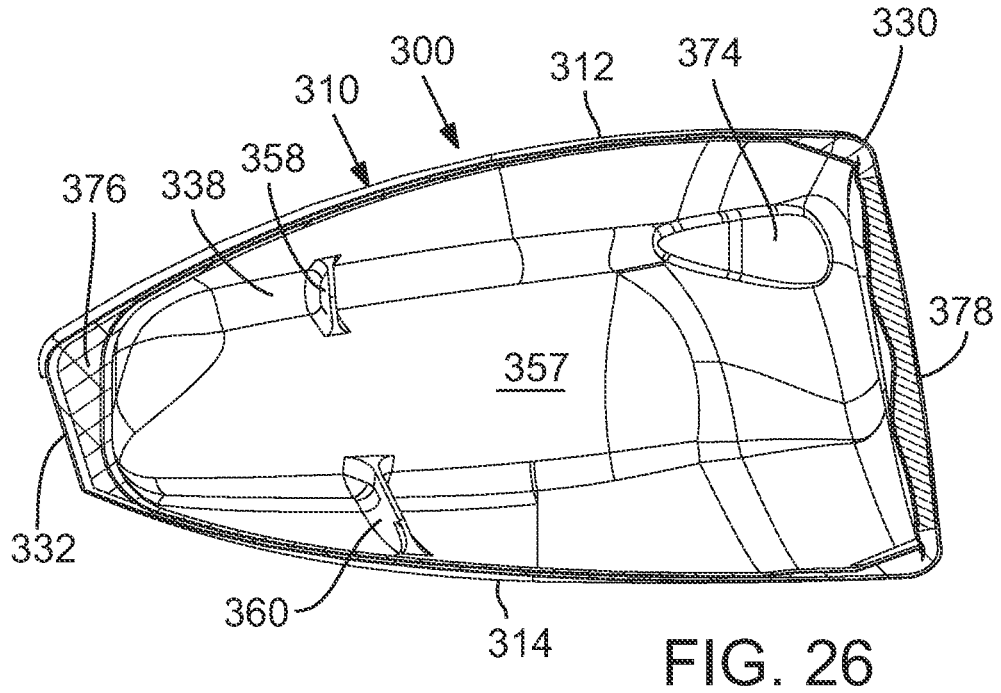
FIG. 26 is a cross-sectional side view of the golf club head of FIG. 22 taken along the line 26-26 of FIG. 24 and shown without the hosel.

Referring to FIGS. 25 and 26, golf club head 300 includes a localized heel mass element 374, rear mass element 376 and toe mass element 378. The toe mass element 378 is similar to the heel mass element 374, but positioned on the skirt 314 at the toe portion 328 of the golf club head 310 proximate the front portion 330.

In some implementations, the heel mass element 374 has an origin x-axis coordinate between approximately 35 mm and approximately 65 mm, an origin y-axis coordinate between approximately 10 mm and approximately 40 mm, and an origin z-axis coordinate between approximately 0 mm and approximately 20 mm. In one specific implementation, the heel mass element 374 has an origin x-axis coordinate of approximately 53 mm, an origin y-axis coordinate of approximately 21 mm, and an origin z-axis coordinate of approximately 7 mm. Similarly, in some implementations, the rear mass element 376 has an origin x-axis coordinate between approximately −25 mm and approximately 5 mm, an origin y-axis coordinate between approximately 90 mm and approximately 120 mm, and an origin z-axis coordinate between approximately −5 mm and approximately 25 mm. In one specific implementation, the rear mass element 376 has an origin x-axis coordinate of approximately −10 mm, an origin y-axis coordinate of approximately 109 mm, and an origin z-axis coordinate of approximately 10 mm.

Like mass elements 74, 76, the mass elements 374, 376 can have any one of various masses or weights. For example, in some implementations, the heel mass element 374 has a mass between about 5 g and about 25 g and the rear mass element 376 has a mass between about 10 g and about 30 g. In one specific implementation, the heel mass element 374 has a mass of approximately 11 g and the rear mass element 376 has a mass of approximately 21 g.

The configuration of the golf club head 300, including the locations and mass of the mass elements 374, 376, can, in some implementations, result in the club head having a moment of inertia about the CG z-axis (Izz) between about 450 kg·mm$^2$ and about 600 kg·mm$^2$, and a moment of inertia about the CG x-axis (Ixx) between about 280 kg·mm$^2$ and about 400 kg·mm$^2$. In one specific implementation having mass element locations and masses indicated in FIG. 30, club head 300 has a moment of inertia about the CG z-axis (Izz) of approximately 536 kg·mm$^2$ and a moment of inertia about the CG x-axis (Ixx) of approximately 336 kg·mm$^2$. In this implementation, then, the ratio of Ixx/Izz is approximately 0.63. However, in other implementations, the ratio of Ixx/Izz is between about 0.5 and about 0.9.

Figure 27:
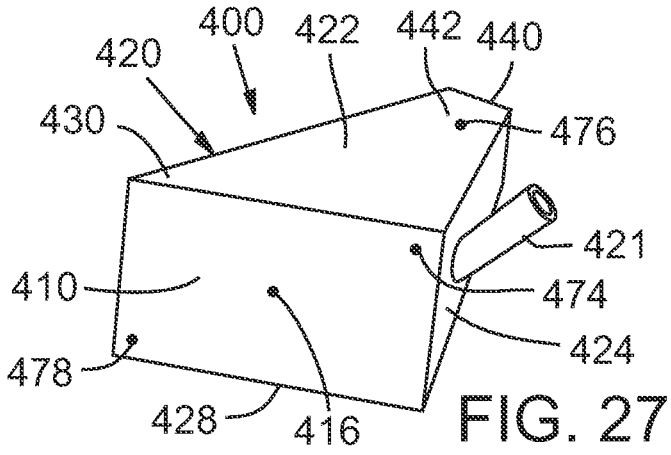
FIG. 27 is a perspective view of a golf club head according to a fifth embodiment.
Figure 28:
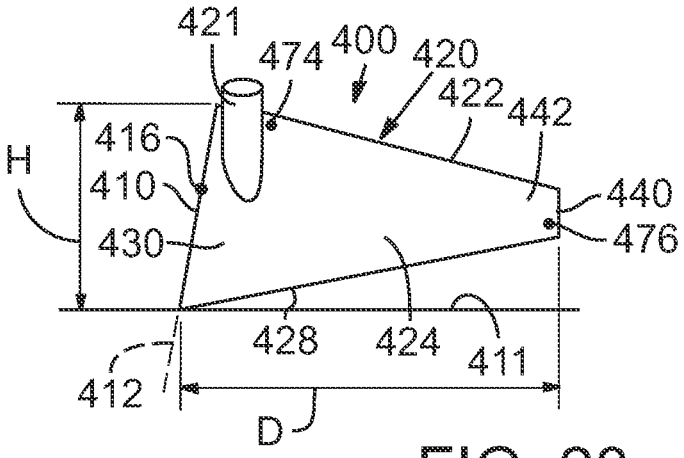
FIG. 28 is a side elevation view of the golf club head of FIG. 27.
Figure 29:
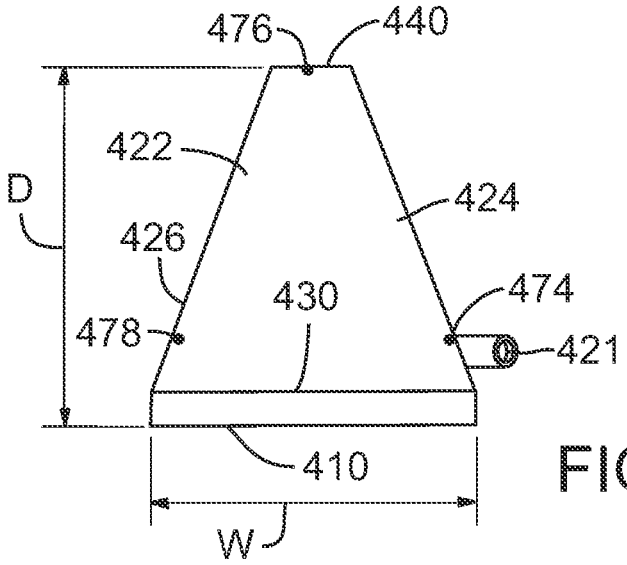
FIG. 29 is a top plan view of the golf club head of FIG. 28.

One specific exemplary implementation of a golf club head 400 having a generally rectangular ball striking face with a corresponding rectangular ball striking surface 410 is shown in FIGS. 27-29. The golf club head 400 includes a body 420 having a hosel 421 and four generally planar sides, i.e., top side 422, right side 424, left side 426, and bottom side 428. The sides 422, 424, 426, 428 extend in a tapering manner from the ball striking surface 410 at a forward portion 430 of the golf club head and converging at a generally square end 440 at a rearward portion 442 of the golf club head. Accordingly, the surface area of the ball striking surface 410 is larger than the cross-sectional surface areas of the body 420 along planes parallel to the striking surface. The golf club head 400 includes a club head origin 416 positioned at the geometric center of the striking surface 410. The origin 416 acts as the origin of a golf club head coordinate system, similar to that described above, of the golf club head 400.

In the illustrated embodiment, the edges, or intersections, between the sides 422, 424, 426, 428, striking surface 410 and end 440 appear relatively sharp. Of course, any one or more of the sharp edges between the sides, striking surface and end can be eased or radiused without departing from the general relationships. In general, the golf club head 400 has a generally pyramidal, prismatic, pyramidal frustum, or prismatic frustum shape. When viewed from above, or in plan view, the golf club head has a generally triangular or trapezoidal shape.

In one specific implementation, for optimum forgiveness and playability, the ball striking surface 410 has the maximum allowable surface area under current USGA dimensional constraints for golf club heads. In other words, the ball striking surface 410 has a maximum height (H) of approximately 71 mm (2.8 inches) and a maximum width (W) of approximately 125 mm (5 inches). Accordingly, the ball striking surface 410 has an area of approximately 8,875 $mm^2$. In other embodiments, the ball striking surface 410 may have a maximum height (H) between about 67 mm to about 71 mm, a maximum width (W) between about 118 mm to about 125 mm, and a corresponding ball striking surface area of between about 7,900 $mm^2$ to about 8,875 $mm^2$.

In certain implementations, the golf club head 400 has a maximum depth (D) equal to the maximum allowable depth under current USGA dimensional constraints, i.e., approximately 125 mm. In other embodiments, the golf club head 400 may have a maximum depth (D) between about 118 mm to about 125 mm. In some implementations, the golf club head 400 has a volume equal to the maximum allowable volume under current USGA dimensional constraints, i.e., approximately 460 $cm^3$. The area of the square end 440 may range from about 342 $mm^2$ to about 361 $mm^2$.

The golf club head 400 includes one or more discrete mass elements. For example, in the illustrated embodiments, the golf club head 400 includes three discrete mass elements: heel mass element 474, rear mass element 476 and toe mass element 478. Each mass element 474, 476, 478 is defined by its location about the golf club head 400 and mass. The location of the mass elements about the golf club head are described according to the coordinates of the mass element CG on the golf club head origin coordinate system.

The golf club head 400 can be configured according to any one of various configurations, e.g., golf club head configurations 400A-400G, each having a unique mass element location and weight to achieve specific moments of inertia Ixx and Izz, and a specific Ixx/Izz ratio. The body 420 of each configuration 400A-400G is constructed of a composite material and the total mass of the golf club head 400 of each configuration 400A-400G is approximately 203 g.

Referring to FIG. 31, the locations and masses of the heel mass element 474, rear mass element 476 and toe mass element 478, as well as the resulting moments of inertia characteristics, for golf club head configurations 400A-400G are shown. As shown, for each golf club head configuration 400A-400G, the moment of inertia about the CG x-axis (Ixx) is between approximately 427 $kg \cdot mm^2$ and approximately 525 $kg \cdot mm^2$, the moment of inertia about the CG z-axis (Izz) is between approximately 447 $kg \cdot mm^2$ and approximately 702 $kg \cdot mm^2$, and the Ixx/Izz ratio is between approximately 0.66 and approximately 0.96.

As indicated in FIG. 31, the location and weight of the three concentrated mass elements has a significant impact on the Ixx/Izz ratio for a given moment of inertia about the CG z-axis (Izz) or CG x-axis (Ixx). For example, golf club head configuration 400A has a moment of inertia about the CG x-axis (Ixx) of approximately 427 $kg \cdot mm^2$ and a moment of inertia about the CG z-axis (Izz) of approximately 645 $kg \cdot mm^2$ to achieve an Ixx/Izz ratio of approximately 0.66. Although the moments of inertia about the CG x-axis (Ixx) and z-axis (Izz) provide high forgiveness on high/low and left/right off-center hits, respectively, the moment of inertia about the CG z-axis (Izz) for this configuration may make it difficult for a golfer to square the club head prior to impact with a golf ball.

As perhaps a more preferable configuration compared to configuration 400A, golf club head configuration 400B can be accomplished by configuring the golf club head to have a toe mass element 478 that is closer to the heel mass element 474 than configuration 400A. The resultant golf club head configuration 400B has the same moment of inertia about the CG x-axis (Ixx) as configuration 400A, but has a moment of inertia about the CG z-axis (Izz), i.e., approximately 593 $kg \cdot mm^2$, that is less than configuration 400A to achieve a slightly higher Ixx/Izz ratio of approximately 0.72. Although golf club head configuration 400B has a lower moment of inertia about the CG z-axis (Izz) than configuration 400B, the moment of inertia is still sufficiently high to provide high forgiveness for left/right off-center hits, while allowing a golfer to more easily square the golf club head prior to impact.

For more ease in squaring the golf club head prior to impact, configuration 400C includes heel and toe mass elements 474, 478 that are closer to each other than configuration 400B to reduce the moment of inertia about the CG z-axis (Izz) and maintain the moment of inertia about the CG x-axis (Ixx) compared to configuration 400C. Accordingly, configuration 400C maintains a very high moment of inertia about the CG x-axis (Ixx) for alleviating the negative effects of high/low impacts and achieves a high moment of inertia about the CG z-axis (Izz) for alleviating the negative effects of right/left impacts. The resultant Ixx/Izz ratio of configuration 400C of approximately 0.96 is significantly higher than the ratio of configuration 400B.

Configuration 400D has a moment of inertia about its z-axis (Izz) and an Ixx/Izz ratio that falls between configuration 400B and configuration 400C.

Configurations 400E-400G follow a similar pattern compared to configurations 400B-400D. More specifically, configuration 400F has a moment of inertia about its z-axis (Izz) and an Ixx/Izz ratio that falls between configuration 400E and configuration 400G. However, the configurations 400E-400G differ from configurations 400B-400D in several respects. Most significantly, the heel and toe mass elements 474, 478 of respective configurations 400E-400G have less weight than the heel and toe mass elements 474, 478 of respective configurations 400B-400D. Additionally, the rear mass elements 476 of respective configurations 400E-400G have more weight than the rear mass elements 476 of respective configurations 400B-400D. In other words, more weight is concentrated in the rear of configurations 400E-400G than in configurations 400B-400D. The result is that the configurations 400E-400G have moments of inertia about respective CG x-axes (Ixx) that are significantly higher than the same moments of inertia achieved by configurations 400B-400C, while the Ixx/Izz ratios of corresponding configurations remain proportionally similar.

Figure 32:
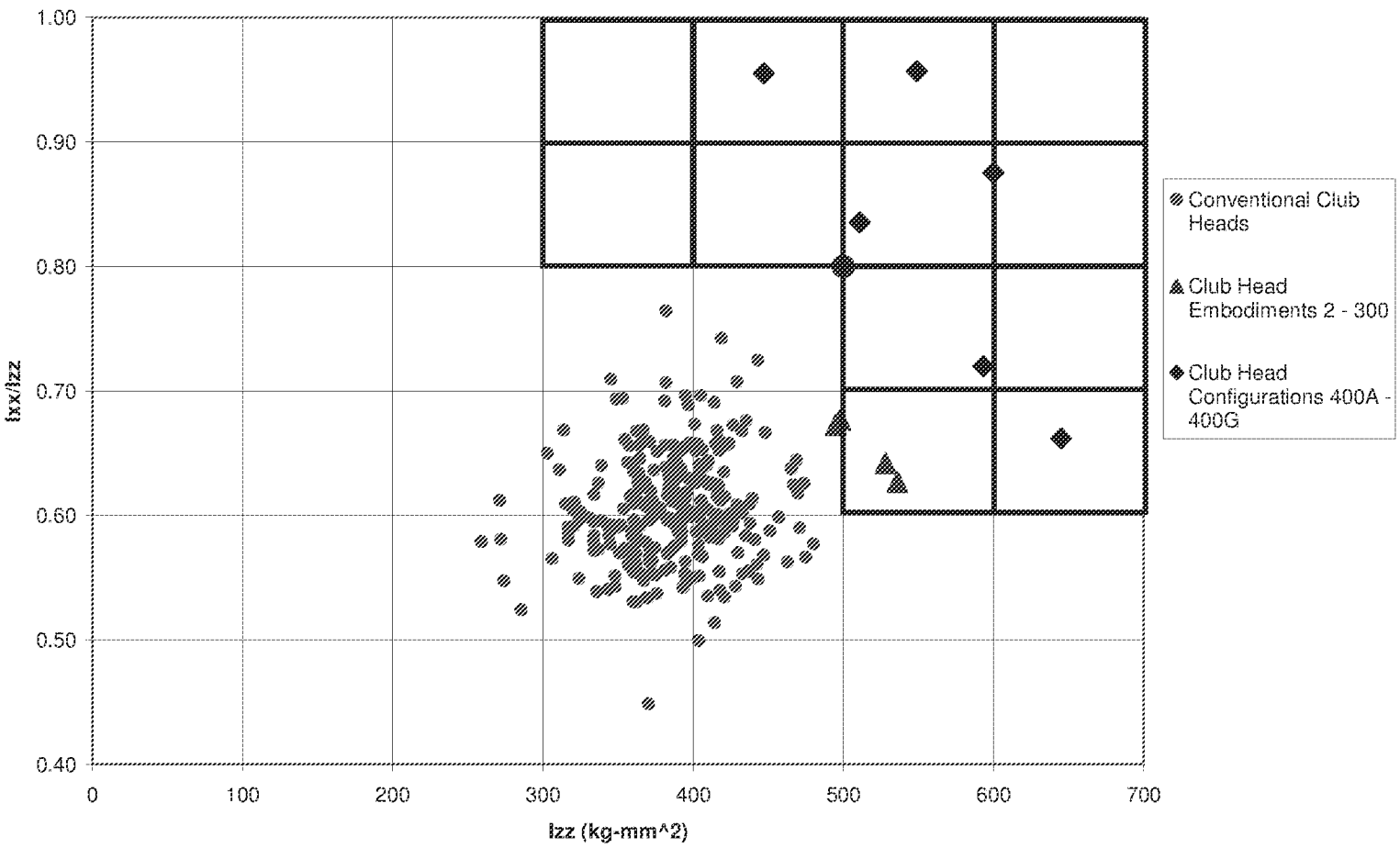
FIG. 32 is a graph showing the ratio of the moment of inertia about the center of gravity x-axis to the moment of inertia about the center of gravity z-axis versus the moment of inertia about the center of gravity z-axis for the first thru fifth golf club head embodiments and various conventional golf club heads.

Referring to FIG. 32, the Ixx/Izz ratio verses the moment of inertia about the z-axis (Izz) for each of the various golf club head embodiments described above is shown. Also shown is the Ixx/Izz ratio verses the moment of inertia about the z-axis (Izz) for a plurality of conventional golf club heads. The conventional golf club heads shown have moments of inertia about their respective CG z-axes (Izz) between about 250 kg·mm$^2$ and 480 kg·mm$^2$, and Ixx/Izz ratios between approximately 0.45 and 0.78. However, no individual conventional golf club head has (1) a moment of inertia about its CG z-axis (Izz) greater than approximately 480 kg·mm$^2$ and an Ixx/Izz ratio greater than approximately 0.6; or (2) a moment of inertia about its CG z-axis (Izz) greater than approximately 440 kg·mm$^2$ and an Ixx/Izz ratio greater than 0.8.

In view of the many possible embodiments to which the principles of the disclosed golf club head may be applied, it should be recognized that the illustrated embodiments are only preferred examples and should not be taken as limiting the scope of the disclosed golf club head. Rather, the scope of the invention is defined by the following claims. We therefore claim as our invention all that comes within the scope and spirit of these claims and their equivalents.

The invention claimed is:

1. A golf club head, comprising:

a sole positioned at a bottom portion of the golf club head;

a crown positioned at a top portion of the golf club head;

a skirt positioned around a periphery between the sole and crown;

a forward portion and a rearward portion; and a face positioned at the forward portion and including a striking surface, the striking surface having a golf club head origin positioned at a geometric center of the striking surface, the golf club head origin including:

an origin x-axis tangential to the face and generally parallel to a ground plane when the golf club head is ideally positioned, an origin y-axis generally perpendicular to the origin x-axis and generally parallel to the ground plane when the golf club head is ideally positioned, and an origin z-axis perpendicular to both the origin x-axis and origin y-axis; and at least one mass element having a mass of at least 5 g and secured to or integrally formed in the golf club head, the at least one mass element located:

rearward of a golf club head center of gravity, and at least 90 mm from the golf club head origin;

wherein:

the rearward portion is configured to at least partially receive and retain a weight below the crown;

the origin x-axis extends in a positive direction from the golf club head origin toward a heel portion of the golf club head, the origin y-axis extends in a positive direction from the golf club head origin towards the rearward portion of the golf club head, and the origin z-axis extends in a positive direction from the golf club head origin towards the crown of the golf club head;

a maximum club head depth of the golf club head is between 115 mm and 130 mm, a maximum club head height is between 55 mm and 75 mm, a maximum club head width is between 110 mm and 130 mm, and a volume of the golf club head is between 420 cm$^3$ and 480 cm$^3$;

the golf club head has a club head mass between 190 grams and 210 grams;

a ratio of a moment of inertia about a golf club head center of gravity x-axis generally parallel to the origin x-axis to a moment of inertia about a golf club head center of gravity z-axis generally parallel to the origin z-axis is from 0.67 to 0.90;

the moment of inertia about the golf club head center of gravity x-axis is less than the moment of inertia about the golf club head center of gravity z-axis;

the moment of inertia about the golf club head center of gravity z-axis is 495-702 kg·mm$^2$;

the golf club head center of gravity has a z-axis coordinate between −8 mm and 0 mm; and the golf club head center of gravity has a y-axis coordinate no less than 33 mm as measured relative to the golf club head origin.

2. The golf club head of claim 1, wherein the maximum club head width is at least 120.5 mm.

3. The golf club head of claim 2, wherein the golf club head center of gravity has a y-axis coordinate between 33 mm and 41 mm as measured relative to the golf club head origin.

4. The golf club head of claim 1, wherein the moment of inertia about the golf club head center of gravity z-axis is at least 75 kg·mm$^2$ greater than the moment of inertia about the golf club head center of gravity x-axis, and the moment of inertia about the golf club head center of gravity x-axis is between 330 kg·mm$^2$ and 550 kg· mm$^2$.

5. The golf club head of claim 4, wherein the moment of inertia about the golf club head center of gravity z-axis is no more than 218 kg·mm$^2$ greater than the moment of inertia about the golf club head center of gravity x-axis.

6. The golf club head of claim 5, wherein the moment of inertia about the golf club head center of gravity z-axis is no more than 177 kg·mm$^2$ greater than the moment of inertia about the golf club head center of gravity x-axis.

7. The golf club head of claim 5, wherein a rearmost portion of the crown is positioned below the golf club head origin.

8. The golf club head of claim 5, wherein the rearward portion of the golf club head configured to at least partially receive and retain the weight comprises a weight port comprising a recessed portion and an aperture within the recessed portion, and the aperture is at least partially threaded.

9. The golf club head of claim 8, wherein the aperture defines an axis and the axis extends through a rear portion of the crown.

10. The golf club head of claim 8, wherein the weight port is contiguous with the mass element.

11. The golf club head of claim 8, wherein one or more ribs are located within the golf club head and contiguous with one or more walls of the weight port.

12. The golf club head of claim 8, wherein at least a portion of the crown has a thickness between approximately 0.55 mm and approximately 0.8 mm.

13. The golf club head of claim 5, wherein the ratio is from 0.68 to 0.84.

14. The golf club head of claim 13, wherein at least a portion of the golf club head apart from the face comprises a composite material.

15. The golf club head of claim 13, wherein at least a portion of the face comprises a composite material and the face has a variable thickness.

16. The golf club head of claim 13, wherein at least a portion of the golf club head comprises a composite material and at least a portion of the face comprises a composite material.

17. The golf club head of claim 5, wherein the ratio is from 0.70 to 0.84.

18. The golf club head of claim 5, wherein the ratio is from 0.70 to 0.75.

19. The golf club head of claim 5, wherein the mass of the at least one mass element is from 10 grams to 35 grams.

20. The golf club head of claim 4, wherein the moment of inertia about the golf club head center of gravity x-axis is no more than 400 kg·mm$^2$, and the moment of inertia about the golf club head center of gravity z-axis is no more than 200 kg·mm$^2$ greater than the moment of inertia about the golf club head center of gravity x-axis.

21. The golf club head of claim 1, wherein the moment of inertia about the golf club head center of gravity x-axis is between 330 kg·mm$^2$ and 550 kg·mm$^2$.

22. The golf club head of claim 1, wherein the moment of inertia about the golf club head center of gravity x-axis is at least 427 kg·mm$^2$.

23. The golf club head of claim 1, wherein the moment of inertia about the golf club head center of gravity z-axis is at least 75 kg·mm$^2$ greater than the moment of inertia about the golf club head center of gravity x-axis, and the ratio is less than 0.84.

24. The golf club head of claim 23, wherein the moment of inertia about the golf club head center of gravity z-axis is no more than 177 kg·mm$^2$ greater than the moment of inertia about the golf club head center of gravity x-axis, a mass of the weight is at least 10 grams, the ratio is less than 0.75, and a portion of the weight is at least 95 mm from the golf club head origin.

25. The golf club head of claim 23, wherein the rearward portion of the golf club head configured to at least partially receive and retain the weight comprises a weight port comprising a recessed portion and an aperture within the recessed portion, and the aperture is at least partially threaded.

26. The golf club head of claim 25, wherein one or more ribs are located within the golf club head and contiguous with one or more walls of the weight port, a mass of the weight is at least 10 grams, and a portion of the weight is at least 103 mm from the golf club head origin.

27. The golf club head of claim 23, wherein at least a portion of the crown has a thickness between approximately 0.55 mm and approximately 0.8 mm, and the ratio is less than 0.75, and a portion of the weight is at least 106 mm from the golf club head origin.

28. The golf club head of claim 23, wherein at least a portion of the golf club head apart from the face comprises a composite material, the ratio is less than 0.75, the mass of the at least one mass element is 10-35 grams, and a portion of the weight is at least 109 mm from the golf club head origin.

29. The golf club head of claim 23, wherein at least a portion of the face comprises a composite material, the face has a variable thickness, and a portion of the weight is at least 106 mm from the golf club head origin.

30. The golf club head of claim 23, wherein at least a portion of the golf club head comprises a composite material and at least a portion of the face comprises a composite material, the ratio is less than 0.75, and a portion of the weight is at least 106 mm from the golf club head origin.

31. The golf club head of claim 23, wherein the golf club head center of gravity y-axis coordinate is no more than 41 mm, the ratio is less than 0.75, and the mass of the at least one mass element is from 10 grams to 35 grams.

32. The golf club head of claim 23, wherein the maximum club head width is at least 120.5 mm, the moment of inertia about the golf club head center of gravity x-axis is at least 330 kg·mm$^2$, the golf club head center of gravity y-axis coordinate is at least 36.7 mm, and a portion of the weight is at least 109 mm from the golf club head origin.

33. The golf club head of claim 1, wherein the golf club head is made from a combination of materials comprising one or more composite materials and one or more metal alloys;

at least a portion of the face is separately formed and attached to the golf club head; and at least a portion of the golf club head apart from the face comprises aluminum.

34. A golf club head, comprising:

a sole positioned at a bottom portion of the golf club head;

a crown positioned at a top portion of the golf club head;

a skirt positioned around a periphery between the sole and crown;

a forward portion and a rearward portion; and a face positioned at the forward portion of the golf club head and including a striking surface, the striking surface having a golf club head origin positioned at a geometric center of the striking surface, the golf club head origin including:

an origin x-axis tangential to the face and generally parallel to a ground plane when the golf club head is ideally positioned, an origin y-axis generally perpendicular to the origin x-axis and generally parallel to the ground plane when the golf club head is ideally positioned, and an origin z-axis perpendicular to both the origin x-axis and origin y-axis; wherein:

the rearward portion comprises a recessed portion configured to at least partially receive and retain a weight below the crown;

the recessed portion is located rearward of a golf club head center of gravity, and at least a rearwardmost portion of the recessed portion is at least 90 mm from the golf club head origin;

the recessed portion comprises an aperture within the recessed portion, and the aperture is at least partially threaded;

a rearmost portion of the crown is positioned below the golf club head origin;

the origin x-axis extends in a positive direction from the golf club head origin toward a heel portion of the golf club head, the origin y-axis extends in a positive direction from the golf club head origin towards the rearward portion of the golf club head, and the origin z-axis extends in a positive direction from the golf club head origin towards the crown of the golf club head;

a maximum club head depth of the golf club head is between 110 mm and 130 mm, a maximum club head height is between 55 mm and 75 mm, a maximum club head width is between 110 mm and 130 mm, and a volume of the golf club head is between 420 cm$^3$ and 480 cm$^3$;

the golf club head has a club head mass between 190 grams and 210 grams;

the golf club head center of gravity has a z-axis coordinate between −8 mm and 0 mm as measured relative to the golf club head origin;

the golf club head center of gravity has a y-axis coordinate no less than 33 mm as measured relative to the golf club head origin;

a ratio of a moment of inertia about a golf club head center of gravity x-axis generally parallel to the origin x-axis to a moment of inertia about a golf club head center of gravity z-axis generally parallel to the origin z-axis is from 0.67 to 0.84;

the moment of inertia about the golf club head center of gravity z-axis is at least 75 kg·mm$^2$ greater than the moment of inertia about the golf club head center of gravity x-axis, and the moment of inertia about the golf club head center of gravity x-axis is between 330 kg·mm$^2$ and 550 kg·mm$^2$; and the moment of inertia about the golf club head center of gravity z-axis is at least 495 kg·mm$^2$.

35. The golf club head of claim 34, wherein at least a portion of the golf club head apart from the face comprises a composite material.

36. The golf club head of claim 34, wherein at least a portion of the face comprises a composite material and the face has a variable thickness.

37. The golf club head of claim 34, wherein at least a portion of the golf club head comprises a composite material and at least a portion of the face comprises a composite material.

38. The golf club head of claim 34, wherein the aperture defines an axis, and the axis extends through a rear portion of the crown.

39. The golf club head of claim 34, wherein one or more ribs are located within the golf club head and contiguous with one or more walls of the recessed portion.

40. The golf club head of claim 34, wherein the moment of inertia about the golf club head center of gravity z-axis is no more than 218 kg·mm$^2$ greater than the moment of inertia about the golf club head center of gravity x-axis, and a portion of the weight is at least 103 mm from the golf club head origin.

41. The golf club head of claim 40, wherein the moment of inertia about the golf club head center of gravity z-axis is no more than 177 kg·mm$^2$ greater than the moment of inertia about the golf club head center of gravity x-axis, and a portion of the weight is at least 106 mm from the golf club head origin.

42. The golf club head of claim 40, wherein a rearmost portion of the crown is positioned below the golf club head origin, and a portion of the weight is at least 109 mm from the golf club head origin.

43. The golf club head of claim 40, wherein the rearward portion of the golf club head configured to at least partially receive and retain the weight comprises a weight port comprising a recessed portion and an aperture within the recessed portion, and the aperture is at least partially threaded.

44. The golf club head of claim 43, wherein the aperture defines an axis and the axis extends through a rear portion of the crown, the moment of inertia about the golf club head center of gravity z-axis is no more than 200 kg·mm$^2$ greater than the moment of inertia about the golf club head center of gravity x-axis, and a portion of the weight is at least 106 mm from the golf club head origin.

45. The golf club head of claim 43, wherein one or more ribs are located within the golf club head and contiguous with one or more walls of the weight port, and a mass of the weight is 10-35 grams.

46. The golf club head of claim 43, wherein at least a portion of the crown has a thickness between approximately 0.55 mm and approximately 0.8 mm, the ratio is no more than 0.75, the club head mass is no more than 204.4 grams, and a portion of the weight is at least 106 mm from the golf club head origin.

47. The golf club head of claim 34, wherein the ratio is at least 0.70, and the maximum club head depth is at least 115 mm.

48. The golf club head of claim 47, wherein the maximum club head depth is at least 118 mm, the ratio is no more than 0.75, the golf club head center of gravity y-axis coordinate is at least 36.7 mm, and a portion of the weight is at least 109 mm from the golf club head origin.

49. The golf club head of claim 34, wherein:

the golf club head is made from a combination of materials comprising one or more composite materials and one or more metal alloys;

at least a portion of the face is separately formed and attached to the golf club head; and at least a portion of the golf club head apart from the face comprises aluminum.

50. A golf club head, comprising:

a sole positioned at a bottom portion of the golf club head;

a crown positioned at a top portion of the golf club head;

a skirt positioned around a periphery between the sole and crown;

a forward portion and a rearward portion; and a face positioned at the forward portion and including a striking surface, the striking surface having a golf club head origin positioned at a geometric center of the striking surface, the golf club head origin including:

an origin x-axis tangential to the face and generally parallel to a ground plane when the golf club head is ideally positioned, an origin y-axis generally perpendicular to the origin x-axis and generally parallel to the ground plane when the golf club head is ideally positioned, and an origin z-axis perpendicular to both the origin x-axis and origin y-axis; and at least one mass element having a mass of at least 5 g and secured to or integrally formed in the golf club head, the at least one mass element located:

rearward of a golf club head center of gravity, and at least 90 mm from the golf club head origin;

wherein:

the rearward portion is configured to at least partially receive and retain a weight below the crown;

the origin x-axis extends in a positive direction from the golf club head origin toward a heel portion of the golf club head, the origin y-axis extends in a positive direction from the golf club head origin towards the rearward portion of the golf club head, and the origin z-axis extends in a positive direction from the golf club head origin towards the crown of the golf club head;

a maximum club head depth of the golf club head is between 115 mm and 130 mm, a maximum club head height is between 55 mm and 75 mm, a maximum club head width is between 110 mm and 130 mm, and a volume of the golf club head is between 420 cm$^3$ and 480 cm$^3$;

a ratio of a moment of inertia about a golf club head center of gravity x-axis generally parallel to the origin x-axis to a moment of inertia about a golf club head center of gravity z-axis generally parallel to the origin z-axis is from 0.67 to 0.90;

the moment of inertia about the golf club head center of gravity x-axis is less than the moment of inertia about the golf club head center of gravity z-axis;

the moment of inertia about the golf club head center of gravity z-axis is 495-702 $kg \cdot mm^2$;

the moment of inertia about the golf club head center of gravity x-axis is axis is no more than 400 $kg \cdot mm^2$, and the moment of inertia about the golf club head center of gravity z-axis is no more than 200 $kg \cdot mm^2$ greater than the moment of inertia about the golf club head center of gravity x-axis;

the golf club head has a club head mass between 190 grams and 210 grams;

the golf club head center of gravity has a z-axis coordinate between −8 mm and 0 mm; and the golf club head center of gravity has a y-axis coordinate no less than 33 mm as measured relative to the golf club head origin.

51. The golf club head of claim 50, wherein the moment of inertia about the golf club head center of gravity z-axis is at least 75 $kg \cdot mm^2$ greater than the moment of inertia about the golf club head center of gravity x-axis, the moment of inertia about the golf club head center of gravity x-axis is at least 330 $kg \cdot mm^2$, and the ratio is less than 0.84.

52. The golf club head of claim 51, wherein the moment of inertia about the golf club head center of gravity z-axis is no more than 177 $kg \cdot mm^2$ greater than the moment of inertia about the golf club head center of gravity x-axis, the mass of the at least one mass element is from 10 grams to 35 grams, and the ratio is less than 0.75.

53. The golf club head of claim 51, wherein the rearward portion of the golf club head configured to at least partially receive and retain the weight comprises a weight port comprising a recessed portion and an aperture within the recessed portion, the aperture is at least partially threaded, the maximum club head depth is at least 117.2 mm, and a portion of the weight is at least 103 mm from the golf club head origin.

54. The golf club head of claim 53, wherein one or more ribs are located within the golf club head and contiguous with one or more walls of the weight port, the mass of the at least one mass element is from 10 grams to 35 grams, the ratio is less than 0.75, and a portion of the weight is at least 109 mm from the golf club head origin.

55. The golf club head of claim 50, wherein at least a portion of the crown has a thickness between approximately 0.55 mm and approximately 0.8 mm, and at least a portion of the golf club head apart from the face comprises a composite material.

56. The golf club head of claim 50, wherein at least a portion of the face comprises a composite material, the face has a variable thickness, and a portion of the weight is at least 106 mm from the golf club head origin.

57. The golf club head of claim 50, wherein at least a portion of the golf club head comprises a composite material and at least a portion of the face comprises a composite material, and the ratio is less than 0.75.

58. The golf club head of claim 50, wherein the golf club head center of gravity y-axis coordinate is no more than 41 mm, and the ratio is less than 0.75.

59. The golf club head of claim 50, wherein the maximum club head depth is at least 118 mm, the maximum club head width is at least 120.5 mm, the golf club head center of gravity y-axis coordinate is at least 36.7 mm, the ratio is 0.70-0.75, and a portion of the weight is at least 109 mm from the golf club head origin.

60. The golf club head of claim 50, wherein a rearmost portion of the crown is positioned below the golf club head origin, the golf club head has a club head mass between 190 grams and 204.4 grams, the moment of inertia about the golf club head center of gravity z-axis is no more than 177 $kg \cdot mm^2$ greater than the moment of inertia about the golf club head center of gravity x-axis, the ratio is less than 0.75, and at least a portion of the crown has a thickness between approximately 0.55 mm and approximately 0.8 mm.

61. The golf club head of claim 50, wherein:

the golf club head is made from a combination of materials comprising one or more composite materials and one or more metal alloys;

at least a portion of the face is separately formed and attached to the golf club head; and at least a portion of the golf club head apart from the face comprises aluminum.

* * * * *